US007661521B2

(12) United States Patent
Abe et al.

(10) Patent No.: US 7,661,521 B2
(45) Date of Patent: Feb. 16, 2010

(54) COIN SELECTOR

(75) Inventors: Hiroshi Abe, Saitama (JP); Yoshinobu Tanaka, Saitama (JP)

(73) Assignee: Asahi Seiko Company Ltd., Tokyo (JP)

( * ) Notice: Subject to any disclaimer, the term of this patent is extended or adjusted under 35 U.S.C. 154(b) by 73 days.

(21) Appl. No.: 11/776,093

(22) Filed: Jul. 11, 2007

(65) Prior Publication Data

US 2008/0011578 A1 Jan. 17, 2008

(30) Foreign Application Priority Data

Jul. 12, 2006 (JP) ..... 2006-192150
Sep. 26, 2006 (JP) ..... 2006-261399
Nov. 15, 2006 (JP) ..... 2006-309609

(51) Int. Cl.
*G07F 1/04* (2006.01)

(52) U.S. Cl. ..... 194/344

(58) Field of Classification Search ..... 194/344; 453/14

See application file for complete search history.

(56) References Cited

U.S. PATENT DOCUMENTS 2,073,949 A * 3/1937 Scofield ..... 194/326
2,230,566 A * 2/1941 Hakanson ..... 194/323
2,453,437 A * 11/1948 Hokanson ..... 194/326
2,816,639 A * 12/1957 Miller ..... 194/344
3,586,146 A * 6/1971 Heirbaut et al. ..... 194/244
4,960,196 A * 10/1990 Kanehara et al. ..... 194/215
5,441,447 A * 8/1995 Okada ..... 453/32
6,193,045 B1 * 2/2001 Ishida et al. ..... 194/203
6,398,001 B1 * 6/2002 Hutchinson et al. ..... 194/317
6,425,471 B1 * 7/2002 Guindulain Vidondo .... 194/203
6,499,581 B2 * 12/2002 Yoshida et al. ..... 194/318
2001/0008831 A1 * 7/2001 Mori et al. ..... 453/3

FOREIGN PATENT DOCUMENTS

JP 5-282514 10/1993
JP 2005-312818 11/2005

* cited by examiner

*Primary Examiner*—Patrick Mackey
*Assistant Examiner*—Mark Beauchaine
(74) *Attorney, Agent, or Firm*—McGlew and Tuttle, P.C.

(57) ABSTRACT

A coin selector prevents illegal actuation of a coin sensor for real coin detection and is reduced in size and has a high coin processing rate, and which can cancel a coin to be cancelled reliably. The coin selector detects the passage of a coin based upon a signal from a coin sensor disposed downstream of a real/fake discriminating unit formed along a coin passage through which the coin moves. A moving direction changing unit for a coin is provided on the coin passage downstream of the real/fake discriminating unit and the coin passage downstream of the moving direction changing unit is disposed on a plane different from a plane on which the moving direction changing unit is present.

25 Claims, 19 Drawing Sheets

(A)

(B)

(A)

(B)

COIN SELECTOR

CROSS REFERENCE TO RELATED APPLICATIONS

This application claims the benefit of priority under 35 U.S.C. §119 of Japan Patent Application JP-A-2006-192150 filed, Jul. 12, 2006, Japan Patent Application JP-A-2006-261399 filed, Sep. 26, 2006 and Japan Patent Application JP-A-2006-309609 filed, Nov. 15, 2006 filed, the entire contents of each of which are incorporated herein by reference.

FIELD OF THE INVENTION

The present invention pertains to a coin selector that performs a discrimination as to the real/fake status of a coin used in a gaming device such as a pachinko-slot machine or the like. The present invention relates to a coin selector that prevents an illegal action due to a coin sensor that makes a determination as to authenticity of a coin. The present invention more particularly relates to a small-sized and inexpensive coin selector that prevents improper or illegal actions toward a coin sensor. In particular, the present invention relates to a coin selector that can prevent such an event that a coin to be cancelled is received without cancelling the same.

The coin selector according to the present invention can be used in not only for gaming machines such as a pachinko-slot machine but also a game machine of a coin type or an automatic vending machine. In this text, the term "coin" is a collective term generally referring to any and all of coins, disks, disk-like medals, a token, or the like.

BACKGROUND OF THE INVENTION

Japanese Patent No. 3649728 (FIG. 1 to FIG. 4, page 2 to page 5) shows conventional features known in the art including a coin selector which has a con passage provided along a guide rail and a diameter sorting unit that is a real/fake discriminating unit disposed in the coin passage. A diameter of a coin moving on the guide rail while rolling in the coin passage is selected by the diameter sorting unit. Only a coin having a predetermined diameter passes through the diameter sorting unit to be received as a real coin. A plurality of photoelectric sensors are disposed in the coin passage in order to detect reception of the real coin, and processing of signals from the coin sensors are devised to prevent illegal action.

JP-A-05-282514 (FIGS. 2 to 4, page 2 to page 4) is a second conventional arrangement known in the art. This reference discloses an apparatus where a fake coin is sorted in a sorting portion disposed in a route where a coin inserted from a slot port rolls in a coin passage. A coin is sorted to a receiving portion or a cancel passage by switching a passage switching portion disposed downstream of the sorting portion. A pass detecting portion is disposed between the sorting portion and the switching portion. A slotting detecting portion is disposed downstream of the switching portion. A detection signal of a coin is output only when a detection signal from the slotting detecting portion is received within a predetermine time period after a coin is detected at the pass detecting portion.

In recent years, a problem of illegal action regarding the coin selector according to Japanese Patent No. 3649728 arises wherein an erroneous determination is made as if a real coin has been detected by slotting a plate-like tool whose distal end is attached with an infrared light emitter from the coin slotting port of the game machine and properly causing the light emitter to emit light to cause the coin sensor to transmit a detection signal in a pseudo manner so that a coin(s) is acquired irregularly.

According to JP-A-05-282514, since the slotting detecting portion is disposed at a position where the coin passage forms a right angle, it is difficult to insert a tool for conducting illegal action so that security to illegal action is improved as compared with Japanese Patent No. 3649728. However, according to JP-A-05-282514, since the sorting portion, a direction changing portion (the passage switching portion), and the slotting detecting portion are arranged in series, the apparatus is increased in size, so that it may not installed in a predetermined range in the pachinko-slot machine.

SUMMARY OF THE INVENTION

A first object of the present invention is to provide a coin selector that prevents illegal access to a coin sensor for real coin detection.

A second object of the present invention is to provide a small-sized coin selector that prevents illegal access to a coin sensor.

A third object of the present invention is to provide a coin selector that prevents illegal access to a coin sensor, where a processing rate of coins is fast.

A fourth object of the present invention is to provide a coin selector that can cancel a coin reliably when a possibility is high that a coin to be cancelled cannot be cancelled.

In order to achieve the object, the coin selector according to the present invention is configured with a coin selector that detects passage of a coin based upon a signal from a coin sensor disposed downstream of a real/fake discriminating unit formed along a coin passage through which a coin moves. A coin moving direction changing unit is provided in the coin passage positioned downstream of the real/fake discriminating unit. A coin detecting passage positioned downstream of the moving direction changing unit is disposed on a plane different from a plane on which the moving direction changing unit is present.

The coin cancel unit may be disposed on the moving direction changing unit. The coin sensor may be disposed in the coin passage positioned downstream of the moving direction changing unit. The plains may be inclined to a horizontal line. A timing sensor may be disposed between the real/fake discriminating unit and the moving direction changing unit.

A pullback preventing unit may be provided downstream of the moving direction changing unit. A coin passage of the moving direction changing unit and the coin detecting passage may be connected to each other through a displacement guiding unit. The displacement guiding unit may include an inclined guiding face inclined to the first plane. The displacement guiding unit is a guiding body that is movable between a standby position on extension of a coin guiding rail of the real/fake discriminating portion and a guiding position inclined downwardly toward the side of the coin detecting passage according to a weight of a coin. The guiding body can pivot about a pivoting shaft at the opposite side of the coin detecting passage. A cancel body that advances to and retracts from the coin passage positioned above the displacement guiding unit and has an inclined guiding edge inclined from the side of the coin detecting passage of the guiding body to the side of the pivoting shaft, and a side face guiding body that is positioned upstream of the cancel body and defines a side face of the coin passage on the opposite side of the cancel body may be provided.

The coin sensor may comprise a plurality of sensors, and the plurality of sensors may be sensors of a different type of detecting system. A shutter unit that closes the coin detecting passage except for a passing time of a coin may be disposed downstream of the coin sensor. The shutter unit may be held at a closing position of the coin passage due to its self-moment. The moving direction changing portion guiding body may move integrally with the cancel body, and may move in a direction of separating from the cancel body, and may be biased toward the side of the cancel body by a predetermined moment. The moving direction changing portion guiding body may be formed in an inverted L shape, a distal end portion of a horizontal portion is rotatably attached at an upper end of a stay extending from the cancel body upwardly, and a lower end of a guiding portion stands in a vertical manner of the moving direction changing portion guiding body is rotatable in a direction of separating from the cancel body and the moving direction changing portion guiding body is biased to the side of the cancel body by its self-weight.

With such a configuration, a coin rolls in a coin passage to reach the real/fake discriminating unit. In the real/fake discriminating unit, a fake coin is eliminated so that a moving direction of only a real coin is changed in the downstream moving direction changing unit. Since a rolling resistance of the real coin increases in the moving direction changing unit, a rolling velocity of the real coin is decelerated. The real coin that has passed through the moving direction changing unit is guided to the coin passage positioned on the plane different from the plane on which the moving direction changing unit is disposed. In other word, the real coin is guided to the coin detecting passage displaced to the coin passage of the moving detection changing unit. Therefore, the real coin moves from the coin passage to the coin detecting passage in a three-dimensional manner. The real coin moving in the coin detecting passage is detected by the coin sensor disposed in the coin detecting passage. The detecting signal is a real coin receiving signal.

When an illegal action is performed to the coin sensor disposed in the coin passage displaced downstream of the moving direction changing unit, an inserted tool for illegal action must be opposed to the coin sensor by causing the tool for illegal action to pass through the moving direction changing unit from the coin passage utilizing flexibility of the tool for illegal action and further causing the tool for illegal action to advance in the coin detecting passage. In other words, the tool for illegal action must be bent in a three-dimensional manner. It is considerably difficult to operate a base portion of the tool for illegal action bent in the three-dimensional manner to move a light emitting portion of a distal end of the tool for illegal action to an accessible position to the coin sensor. Therefore, it is substantially impossible to perform the illegal action to the coin sensor for real coin detection so that illegal action can be prevented.

Providing the cancel unit for cancelling reception of a real coin in the moving direction changing unit is advantageous. Since two devices of the moving direction changing unit and the cancel unit are disposed at one portion, the apparatus can be reduced in size.

Providing the coin sensor to be disposed in the coin detecting passage downstream of the moving direction changing unit is advantageous. A passage in which a coin rolls from the coin passage to the coin detecting passage is bent in the three-dimensional manner. Therefore, since the tool for illegal action must also be bent in a three-dimensional manner, it is considerably difficult to insert the tool for illegal action so as to be accessible to the coin sensor, so that illegal action using a tool for illegal action can be prevented.

Providing the coin passage inclined to a horizontal line, such that a coin moves while one face thereof and is guided by a lower face of the inclination is advantageous. A moving attitude of the coin is stabilized so that precision of real/fake discrimination can be increased.

Providing that the timing sensor is disposed between the real/fake discriminating unit and the moving direction changing unit, allows for an abnormality to be discriminated by discriminating occurrence timings between the timing sensor and the coin sensor.

With the pullback preventing unit disposed downstream of the moving direction changing unit, pullback performed by stringing can be prevented.

With the coin passage of the moving direction changing unit and the coin detecting passage connected to each other by the displacement guiding unit, a coin can smoothly move to the coin detecting passage displaced to the coin passage. Sorting of coins can be performed at a rate similar to that in the conventional art.

The displacement guiding unit comprising the inclined guiding face inclined to the first plane allows for a simple configuration to be achieved and manufacture is made possible at a low cost.

When the displacement guiding unit is a guiding body and coin does not ride on the guiding body, the guiding body is positioned on an extension of the coin guide rail in the real/fake discriminating unit. When a real coin has ridden on the guiding body, the guiding body is inclined downwardly toward the coin detecting passage due to a coin weight. Therefore, a real coin drops along the inclination of the guiding body and drops in the coin detecting passage so that it is detected. When a real coin is not received, the coin is deflected by the cancel body so that the guiding body is not moved to the guiding position. Therefore, the real coin is not guided to the coin detecting passage. The guiding body is moved to the guiding position inclined by the weight of the coin, and it is normally moved to a standby position by its self-moment. Therefore, since the guiding body does not require a driving source, it can be manufactured at a low cost. Further, since a coin is guided to the coin detecting passage according to the inclination of the guiding body, it is guided to the coin detecting passage smoothly.

When the cancel body is positioned in the coin passage, a real coin is moved to the side of a pivot shaft of the guiding body by a cancel edge of the cancel body to be deflected from the coin passage so that it is not guided to the coin detecting passage. Further, when the coin is guided to the coin detecting passage, a side face thereof is guided above the guiding body by the moving direction changing portion guiding body positioned laterally of the coin. Therefore, even if the coin becomes unstable on the guiding body, since the coin is guided by the moving direction changing portion guiding body, the coin can be guided to the coin detecting passage reliably without dropping from the guiding body. When a real coin is not received, the coin is deflected toward the pivot shaft of the guiding body by the cancel body. Therefore, even if the coin rides on the guiding body, a moment inclined downwardly toward the coin detecting passage does not act on the guiding body, the guiding body can be made from a weight so that inexpensive configuration can be achieved.

With the feature that the coin sensor comprises a plurality of sensors of different detecting systems, for an illegal action to be performed, a procedure must be conducted so as to cause erroneous detections in sensors of different types. As such it is difficult to perform an illegal action.

The feature of the shutter unit that closes the coin detecting passage disposed downstream of the coin sensor except for the passage of a coin provides advantages. This is particularly the coin detecting passage being positioned downstream of the sensor being put in a closed state by the shutter unit. In this case, even if insertion of a tool for illegal action from an outlet of the coin selector is tried, the insertion is prevented by the shutter unit; such that illegal action to the coin sensor cannot be performed.

With the shutter unit is held at a closing position of the coin passage by its self-moment, the shutter unit closes the coin detecting passage by the self-moment and it is moved by a coin when the coin passes through the coin detecting passage, so that the shutter unit does not obstruct to rolling of a coin. Further, since it is unnecessary to provide a driving device for the shutter unit, an inexpensive configuration can be achieved.

With the moving direction changing portion guiding body moving integrally with the cancel body, it can be moved in a direction of separation from the cancel body, and it is biased to the side of the cancel body by a predetermined moment. Therefore, the cancel body and the moving direction changing portion guiding body can be normally held in a predetermined distance relationship therebetween by a predetermined force. In a case that a plurality of coins are jammed between the cancel body and the moving direction changing portion guiding body, when pressure of the coins exceeds a predetermined value, the moving direction changing portion guiding body is moved in a direction of separation from the cancel body. Thereby, the coins are deflected from the coin passage by the cancel body, so that they can be cancelled. Therefore, an event in which a plurality of coins are jammed between the cancel body and the moving direction changing portion guiding body and they can not move can be prevented.

With the moving direction changing portion guiding body formed in an inverted L shape, a distal end portion of a horizontal portion is rotatably attached at an upper end of a stay extending from the cancel body upwardly, and a lower end of a guiding portion stands in a vertical manner of the moving direction changing portion guiding body is rotatable in a direction of separating from the cancel body and the moving direction changing portion guiding body is biased to the side of the cancel body by its own weight. Since the moving direction changing portion guiding body has the inverted L shape, the moving direction changing portion guiding body is caused to approach the cancel body by a predetermined force caused by moment due to the its own weight of the moving direction changing portion guiding body. Therefore, as described above, in a case that a plurality of coins are jammed between the cancel body and the moving direction changing portion guiding body, when pressure of the coins exceeds a predetermined value, the moving direction changing portion guiding body is moved in a direction of separating from the cancel body. Thereby, the coins are deflected from the coin passage by the cancel body, so that they can be cancelled. Therefore, event that a plurality of coins are jammed between the cancel body and the moving direction changing portion guiding body and they can not move can be prevented. Further, since the moving direction changing portion guiding body is biased to the cancel body by the predetermined force caused by moment due to the its own weight of the moving direction changing portion guiding body, it is unnecessary to use a weight or a spring, so that an inexpensive configuration can be achieved.

According to the invention, a coin selector is provided that detects the passage of a coin based upon a signal from a coin sensor disposed downstream of a real/fake discriminating unit formed along a coin passage through which a coin moves. A moving direction changing unit that changes the moving direction of the coin to downward is provided in the coin passage positioned downstream of the real/fake discriminating unit. A coin detecting passage positioned downstream of the moving direction changing unit is disposed on a plane different from another plane on which the moving direction changing unit is present. The planes are inclined to a horizontal line, the coin sensor is disposed in the coin passage, a coin cancel unit is disposed in the moving direction changing unit, and a timing sensor is disposed between the real/fake discriminating unit and the moving direction changing unit.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
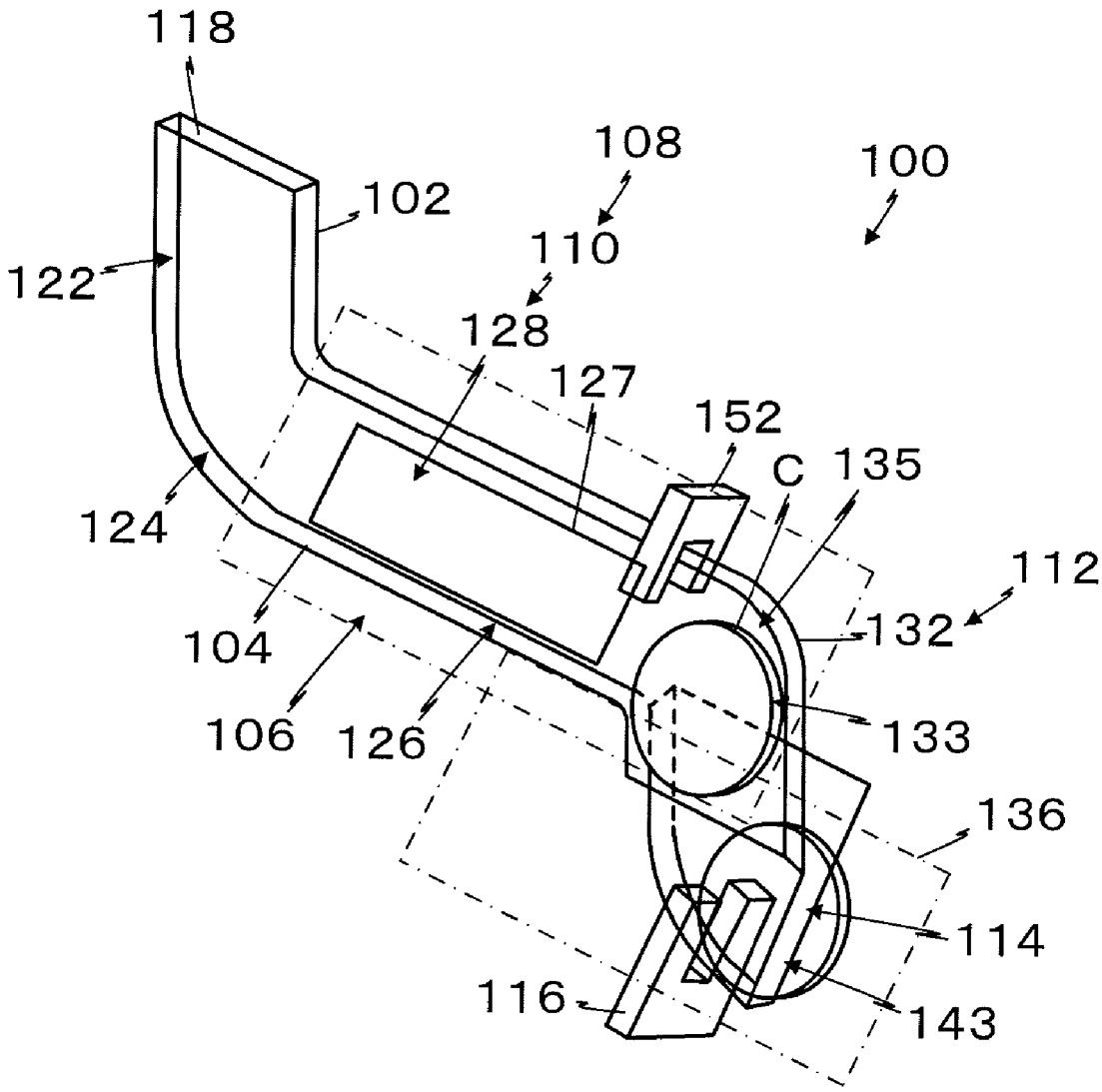
FIG. 1 is a schematic perspective view of a coin selector according to a first embodiment.

Referring to the drawings in particular, in FIG. 1, a coin selector 100 includes a plate-like main body 102, a guide rail 104 positioned at a lower portion of the main body 102, a coin passage 106, a diameter sorting unit 110 that is a real/fake discriminating unit 108 and is disposed in an intermediate portion of the guide rail 104, a moving direction changing unit 112, a coin detecting passage 114 positioned downstream of the moving direction changing unit 112, a second main body 138 (FIGS. 3 and 4) defining the coin detecting passage 114, and a coin sensor 116 disposed in the coin detecting passage 114.

Figure 3:
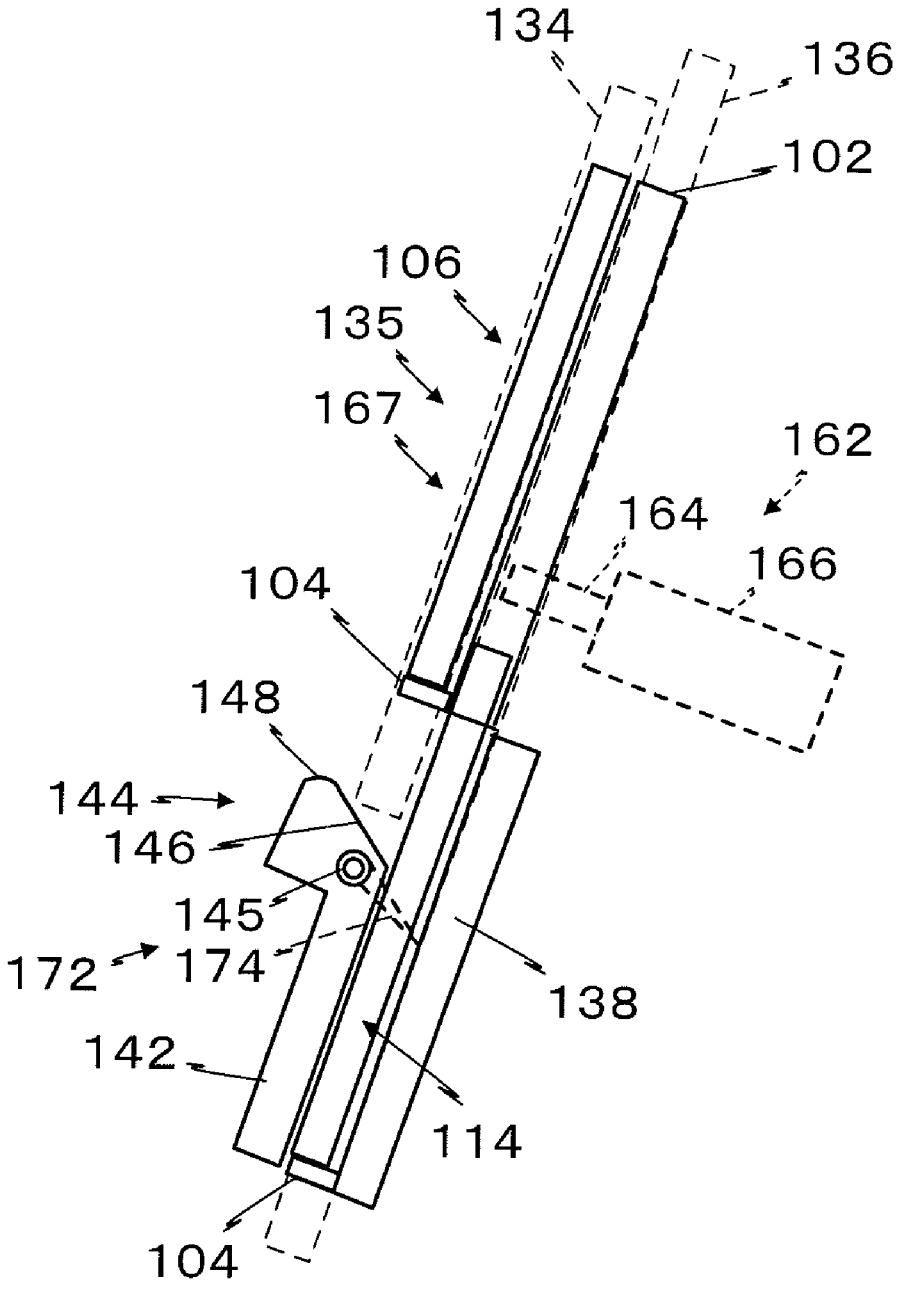
FIG. 3 is a sectional view of the coin selector, taken along line B-B in FIG. 2.

The main body 102 is first explained. The main body 102 has a function of guiding one face of a coin C. Therefore, the main body 102 can be replaced by one having a similar function. The main body 102 in the first embodiment has a flat plate shape, and it is attached in a state that it has been inclined at an angle of about 15° to a vertical line in a clockwise direction, as shown in FIG. 3. The material used for the main body 102 is material having wear resistance property to the coin C, such as metal or resin, and the main body 102 can be manufactured by integral molding or the like.

The guide rail 104 has the function of supporting a peripheral face of the coin C guided to the main body 102 and the second main body 138, and supporting the rolling coin C. The guide rail 104 in the embodiment is attached to lower ends of the main body 102 and the second main body 138, it has approximately the same width as a thickness of the coin C, and it is inclined to fall forward (fall rightward in FIG. 2) at an predetermined angle, for example, at an angle of about 20° and is formed in a straight manner.

Figure 2:
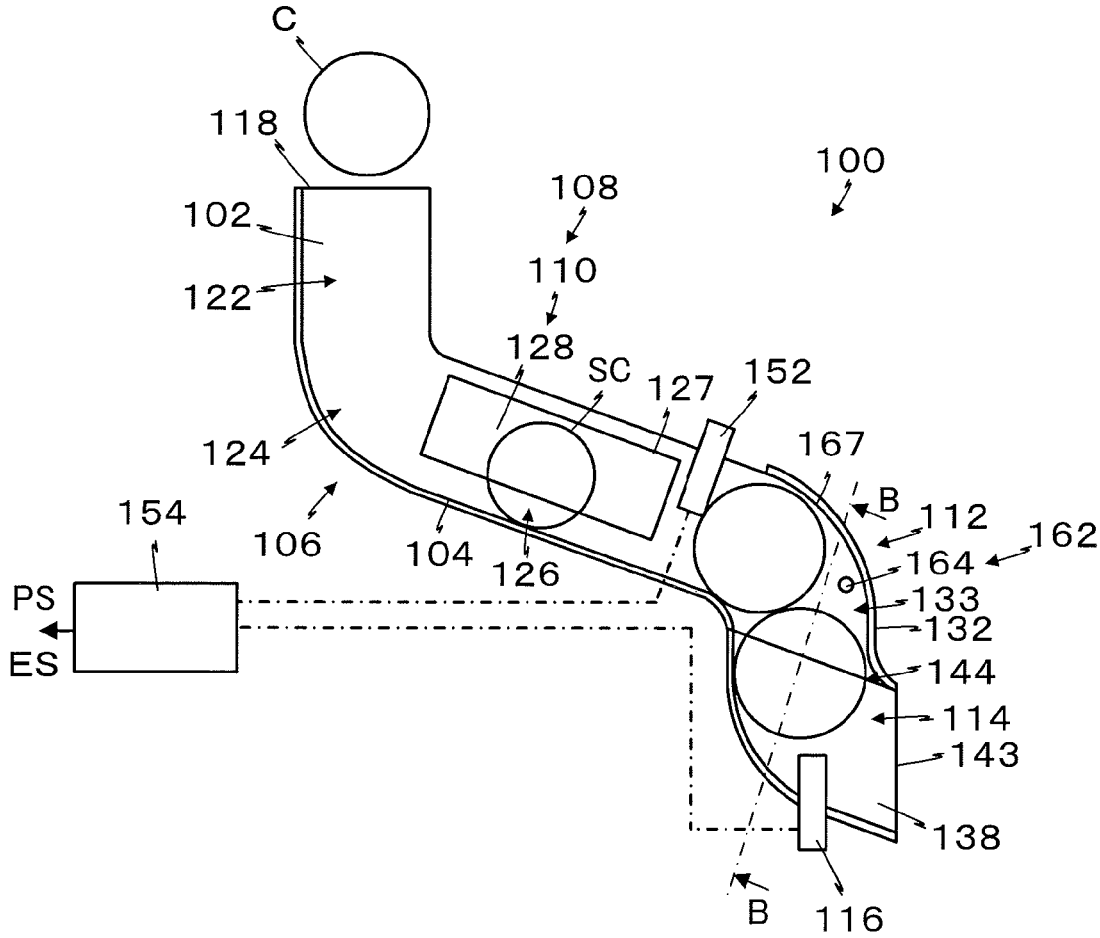
FIG. 2 is a schematic front view of the coin selector according to the first embodiment.

The coin passage 106 is a passage through which a coin C inserted in a slot 118 moves. In first the embodiment, the coin passage 106 is defined by the main body 102 and the guide rail 104, and it has an L shape curved rightward, as shown in FIGS. 1 and 2. The coin passage 106 includes a vertical portion 122 extending from the slot 118 vertically downwardly, an arc portion 124, and an inclined portion 126 inclined to fall rightward. The main body 102 in the vertical portion 122 stands approximately in a vertical manner. Since the main body 102 is inclined to a horizontal line at an angle of about 75°, the inclined portion 126 is similarly inclined at an angle of about 75°. Therefore, after the coin C drops along the vertical portion 122 vertically while being guided by the guide rail 104 and the main body 102, one face of the coin C leans on the main body 102 while the coin C is being turned in a right direction in the arc portion 124, and the coin C rolls on the guide rail 104 to move on the inclined portion 126. When the coin C is jammed in the coin passage 106, the jammed coin C is dropped from the guide rail 104 by a pushing body (not shown) such that it can be returned.

The real/fake discriminating unit 108 has the function of discriminating a real/fake status of an inserted coin to exclude a fake coin. The real/fake discriminating unit 108 in the embodiment is a diameter sorting unit 110 and it is disposed on the inclined portion 126. The diameter sorting unit 110 is a rectangular opening 128 formed in the main body 102 such that an upper end edge 127 has a predetermined distance to the guide rail 104. In the inclined portion 126, an upper end edge of a small-diameter coin whose lower peripheral face is supported by the guide rail 104 and which rolls while its lower face is being supported by the main body 102 is positioned below the upper edge 127. Therefore, since the upper end edge of the small-diameter coin is not guided to the main body 102, the coin falls in the opening 128 to drop from the guide rail 104 so that the coin cannot pass through the diameter sorting unit 110. In other word, when a small-diameter coin SC whose diameter is smaller than a predetermined value is used, a lower end of the small-diameter coin SC is deviated from the guide rail 104 and is dropped to be sorted out in the diameter sorting unit 110. The dropped small-diameter coin SC is returned to a returning port (not shown) through a passage (not shown). When a coin C is larger than an allowable coin, it is stopped at the slot 118 so that it is sorted out. Accordingly, only a coin C whose diameter has a predetermined value, namely, only a real coin can pass through the diameter sorting unit 110.

Next, the moving direction changing unit 112 will be explained. The moving direction changing unit 112 has the function of deflecting a coin C moving on the inclined portion 126 from an extension line of the inclined portion 126. The "deflecting a coin from an extension line" in this text includes the case that a direction of a coin is changed downwardly as shown in the first embodiment and a case that a direction of a coin is changed in a right direction to the coin passage 106 (in a downward direction on a figure plane in FIG. 1) or a direction of a coin is changed in a left direction to the coin passage 106 (in an upward direction of a figure plane in FIG. 1). In the first embodiment, the moving direction changing unit 112 changes a moving direction of a real coin C moving on the guide rail 104 of the inclined portion 126 to a downward direction. The moving direction changing unit 112 according to the first embodiment includes at least an arc-shaped changing guide 132 disposed so as to cross an extension line of the main body 102 and the inclined portion 126. Therefore, the inclined portion 126 and the coin passage 106 of the moving direction changing unit 112 are positioned in a first plane 134 inclined at an angle of about 75° to a horizontal line, as shown in FIG. 3. A moving direction of a coin C rolling on the guide rail 104 while one face thereof is being guided by the main body 102 is changed to downward sharply by the turning guide 132. Specifically, a coin C rolling on the guide rail 104 inclined by an angle of about 20° while the face of the coin C is kept in a state inclined by an angle of about 15° is changed to a direction of about 110° to an advancing direction of the coin C and the moving direction of the coin C is changed to a downward direction on the first plane 134. Therefore, a moving direction of a real coin C moving in the inclined portion 126 is smoothly changed to a downward direction by the changing guide 132. The changing guide 132 has a speed reduction function for reducing a moving speed of a coin C slightly through frictional contact with the coin C. A moving direction changing unit opening 135 is formed on the opposite side of the main body 102 of the coin passage 106 facing the changing guide 132 so that a coin C can drop through the moving direction changing unit opening 135 (see FIG. 4).

The coin detecting passage 114 has the function of guiding a real coin C that has passed through the real/fake discriminating unit 108 and the moving direction changing unit 112. The coin detecting passage 114 is disposed so as to be displaced to the coin passage 106. The term "disposed so as to be displaced" means that the coin passage 106 is positioned on a second plane 136 different from the first plane 134 on which the coin passage 106 is positioned. In the first embodiment, the coin detecting passage 114 comprises a second main body 138 positioned below the main body 102 and disposed in parallel with the main body 102, and a partition wall 142 whose thickness exceeds a thickness of a coin C and which is disposed to be spaced by a distance equal to or less than twice the thickness of a coin. In other words, the second plane 136 on which the coin detecting passage 114 is positioned is parallel with the first plane 134 in the first embodiment and it is deviated from the first plane 134 by a distance in a range of the thickness of the coin C to equal to or less than twice the thickness of the coin or less. The second plane 136 may not be parallel to the first plane 134, but when the second plane 136 is parallel to the first plane 134, easy manufacturing can be achieved. The real coin C moves from the moving direction changing unit 112 to the coin detecting passage 114 via the displacement guiding unit 144. Therefore, since the real coin C is moved laterally (in a right direction in FIG. 3) while being guided in a vertically-downward direction, it moves in a three-dimensional manner.

The displacement guiding unit 144 guides a real coin C smoothly from the moving direction changing unit 112 to the coin detecting passage 114. The displacement guiding unit 144 has an inclined guiding face 146 inclined with an angle of about 45° to the second main body 138 formed at an upper end of the partition wall 142. In other words, the inclined guiding face 146 is inclined with an angle of about 45° to the first plane 134. An upper end of the inclined guiding face 146 is formed in an arc face 148 extending outwardly. Therefore, a coin C guided by the changing guide 132 in the moving direction changing unit 112 moves within the first plane 134 downwardly and a lower end peripheral edge thereof collides against the inclined guiding face 146. Thereby, a lower end of the coin C receives a reaction force acting toward the second main body 138, and the lower end is guided toward the second main body 138. Thereby, the coin C is guided to the coin detecting passage 114 smoothly. When an attitude of a coin C is not stabilized and a lower end of the coin C is deviated to the arc face 148, the coin C is guided to the an upper side of the partition wall 142 by the outward arc face 148, so that it is not guided to the coin detecting passage 114. It is preferable that the inclined guiding face 146 against which a coin C collides is covered with metal such as stainless plate or the like in order to prevent wearing of the inclined guiding face 146 due to collision.

The coin sensor 116 has the function of detecting a real coin C moving in the coin detecting passage 114 to output a detection signal. The coin sensor 116 may be used that is a sensor having the function provided by a photoelectric sensor of a transmission type or a reflection type, a magnetic sensor, a contact-type sensor, or the like.

The timing sensor 152 has the function of detecting a coin C that has passed through the real/fake discriminating unit 108 and to output a detection signal. In the first embodiment, the timing sensor 152 is disposed between the real/fake discriminating unit 108 and the moving direction changing unit 112 so as to face the coin passage 106, and if a sensor can detect a coin C moving in the coin passage 106, a type thereof is not limited like the coin sensor 116.

Figure 5:
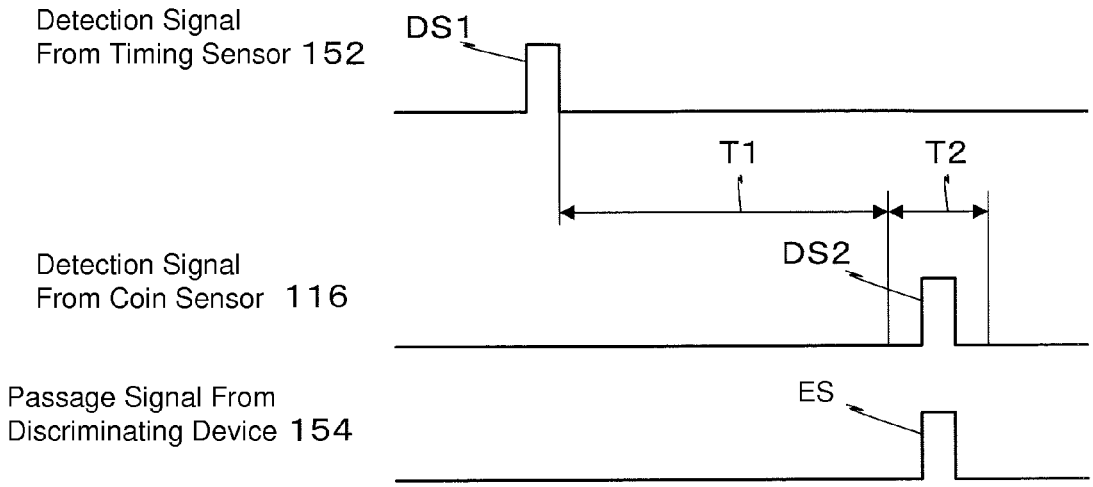
FIG. 5 is a timing chart for explaining an operation of the first embodiment.

The discriminating device 154 has the function of receiving at least a detection signal from the coin sensor 116 to output a passage signal PS of a real coin C. In the first embodiment, the coin sensor 116 and the timing sensor 152 are connected to the discriminating device 154. Based upon an input order of detection signals from the coin sensor 116 and the timing sensor 152 and generation timings of these signals, the discriminating device 154 discriminates truth/false of these signals, and if the signals are normal, the discriminating device 154 outputs a passage signal PS, while it outputs an error signal ES in the case that the signals are abnormal. That is, even if the discriminating device 154 receives detection signals from the coin sensor 116 and the timing sensor 152, when the output order of these signals or an output interval between these signals is abnormal, the discriminating device 154 discriminates such a state as abnormality. Specifically, as shown in FIG. 5, after a detection signal DS1 from the timing sensor 152 is output, when a detection signal DS2 from the coin sensor 116 is output within a predetermined time T2 after a predetermined time T1 elapses, the discriminating device 154 outputs a passage signal PS. When a detection signal DS1 from the timing sensor 152 is outputted next to a detection signal DS2 from the coin sensor 116, when a detection signal DS2 is not outputted from the coin sensor 116 within the predetermined time T2 after the predetermined time T1 from the output of the detection signal DS1 from the timing sensor 152 or when a detection signal DS2 is outputted from the coin sensor 116 before the predetermined time T1 elapses, the discriminating device 154 discriminates such a state as abnormality to output an error signal ES.

The coin cancel unit 162 is used when the coin sensor 116 is not caused to detect a real coin C. In other words, the coin cancel unit 162 has a function of excluding a coin C before the coin C reaches the coin sensor 116 when a device positioned downstream of the coin selector 100 is not in a receivable state of the coin C. In the first embodiment, the coin cancel unit 162 protrudes a deflecting body 164 that pushes a face of a coin C in the coin passage 106 of the moving direction changing unit 112 by a solenoid 166. That is, after a coin C is detected by the timing sensor 152, the coin cancel unit 162 excites the solenoid 166 to protrude the deflecting body 164 into the coin passage 166 and push a side face of the coin C after a predetermined time, thereby pushing the coin C from the moving direction changing unit opening 135 to exclude the coin C from the coin passage 106.

The pullback preventing unit 172 has the function of preventing illegal actions from being performed by connecting a string to a coin C and reciprocating the coin between the coin passage 106 and the coin detecting passage 114 to cause the coin sensor 116 to detect the coin C illegally. In the embodiment, the pullback unit 172 is disposed on an upstream side of the coin sensor 116 in the coin detecting passage 114. The pullback preventing unit 172 includes a blocking body 174. The blocking body 174 is a plate attached to a supporting shaft 145 so as to be pivotally moved and it is biased in a counterclockwise direction in FIG. 3 by a biasing unit (not shown). A distal end of the blocking body 174 is blocked so as not to be rotated by the second main body 138 and the blocking body 174 is stopped so as to cross at an obtuse angle to a moving direction of a coin C. Thereby, when a coin C moves through the coin detecting passage 114 vertically downwardly in FIG. 3, since the blocking body 174 is pushed by the coin C, the coin C pushes the blocking body 174 aside to be capable of passing through the coin detecting passage 114. After the coin C passes through the coin detecting passage 114, the blocking body 174 is returned back to the original position by the biasing unit (not shown), so that the distal end of the blocking body 174 is put in a standby state where it contacts with the second main body 138. When a string connected to the coin C which has passed through the blocking body 174 is pulled up, since the blocking body 174 is pushed up by the coin C and it is pushed against the second main body 138 by a larger force, movement of the coin C is restricted by the blocking body 174 so that the coin C can not be pulled up. Accordingly, an illegal action utilizing a coin attached to a string can be prevented by using the pullback preventing unit 172. A configuration in which the pullback preventing unit 172 is not deployed can be adopted if necessary.

Figure 4:
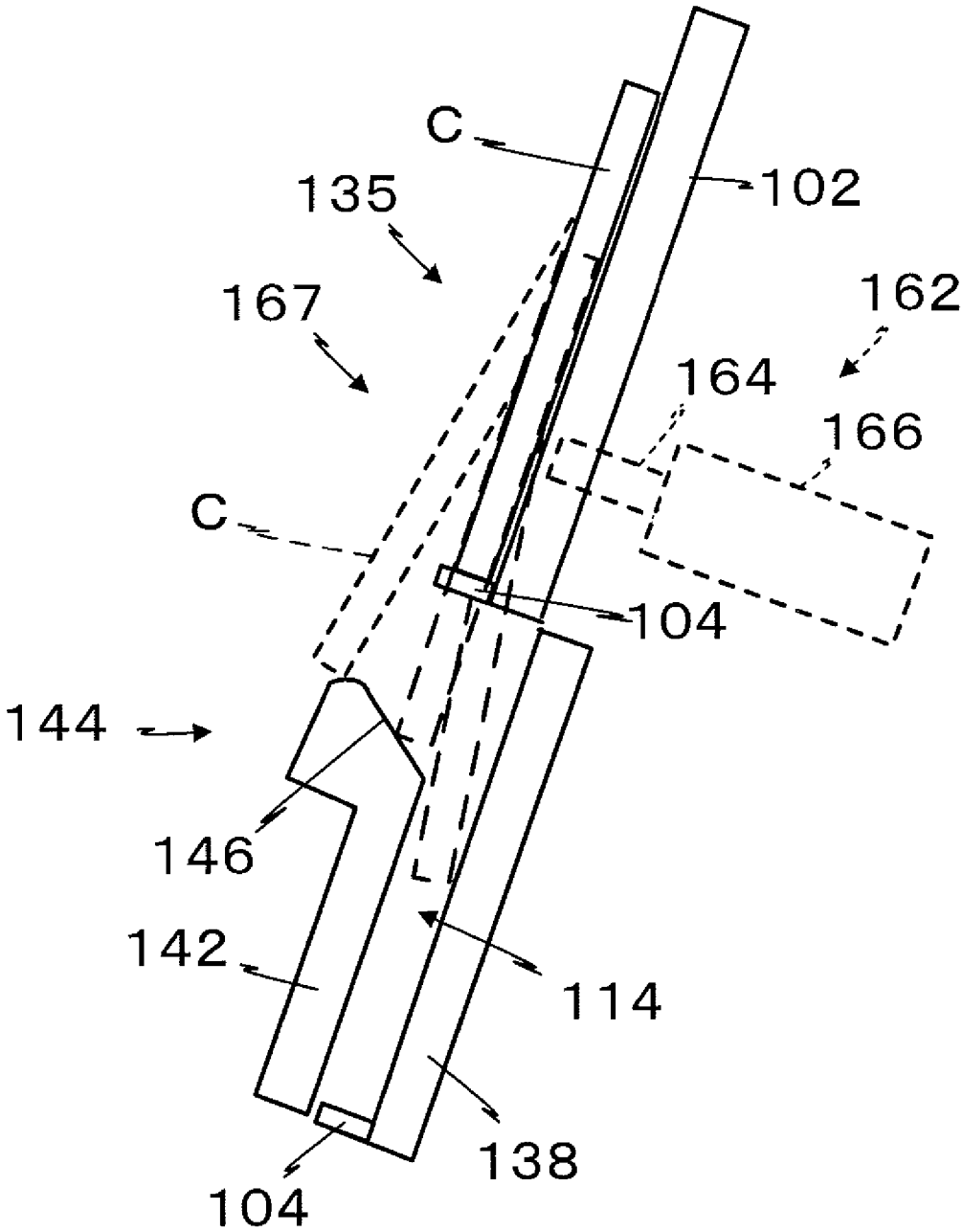
FIG. 4 is a view for explaining an operation of the coin selector according to the first embodiment.

Next, an operation of the coin selector 100 will be explained also referring to FIG. 4. After a coin C is inserted in the slot 118 to drop through the vertical portion 122 along the guide rail 104 vertically, its rolling direction is changed rightward in FIG. 2 in the arc portion 124, and the coin C then rolls on the guide rail 104 in the inclined portion 126 at a predetermined velocity due to its own weight. A small-diameter coin SC is sorted in the diameter sorting unit 110, as described above, so that only real coins C reach the moving direction changing unit 112. The coin C is detected by the timing sensor 152 during its rolling. The moving direction of the coin C is forcibly changed to the downward direction by the changing guide 132 in the moving direction changing unit 112. In other words, the coin C is guided by the turning guide 132 so that the moving direction thereof is changed to the downward direction to the inclined portion 126 by an angle of about 110°. A lower peripheral face of the coin C moving downwardly in the moving direction changing unit 112 collides against the inclined guiding face 146 so that the coin C is guided toward the second main body 138 by a reaction force due to the inclination. Thereby, the coin C is guided to the coin detecting passage 114 positioned on the second plane 136 displaced to the first plane 134. The coin C which has been guided to the coin detecting passage 114 moves in the coin detecting passage 114 to be supplied from an exit 143 to a downstream processing apparatus. The coin C moving in the coin detecting passage 114 is detected by the coin sensor 116. Accordingly, when the discriminating apparatus 154 receives a detection signal DS2 from the coin sensor 114 within the predetermined time T2 after the predetermined time T1 elapses from a detection signal DS1 from the timing sensor 152, it outputs a passage signal PS.

When real coins C are inserted in the slot consecutively, the coins C roll on the guide rail 104 in the inclined portion 126 without clearance to reach the moving direction changing unit 112. A leading coin C is turned downward in the moving direction changing unit 112 while it is being decelerated by the changing guiding unit 132, and it collides against the inclined guiding face 146, so that moving rate of the leading coin C is decelerated and the following coin C rides on an upper end of the leading coin C. Thereby, the following coin C is not guided to the guide rail 104 but it passes through the moving direction changing unit opening 135 to jump from the coin passage 106 and drop. In other words, the coins C can be prevented from rolling in the coin detecting passage 114 without clearance. Accordingly, since coins C do not pass through the coin passage 133 in the moving direction changing unit 112 continuously, a coin C which should not be passed can be excluded from the coin passage reliably, as described later. That is, when a downstream apparatus is not in a coin receivable state, the coin C is detected by the timing sensor 152, the solenoid 166 is excited for a predetermined time after a predetermined time where the coin C just reaches the moving direction changing unit 112 elapses, and the deflecting body 164 is made to protrude into the coin passage 106 in the moving direction changing unit for a moment. Thereby, as shown in FIG. 4, the coin C is hit from its side face in the moving direction changing unit 112 to be deflected from the coin passage 106 to drop from the moving direction changing unit opening 135. Accordingly, the coin C can be prevented from being supplied to the downstream coin processing apparatus reliably.

When an illegal action is performed to the count sensor 116 using a flexible tool for illegal action, a distal end of the tool for illegal action must be caused to reach the coin sensor 116 via the timing sensor 152. In this case, such an operation must be adopted that, after the tool for illegal action is acutely bent in the moving direction changing unit 112, it is bent laterally to an extension direction of the tool in the displacement guiding unit 144, and it is then detected by the coin sensor 116 disposed in the coin detecting passage 114. Therefore, it is considerably difficult to bend the tool for illegal action in this manner. It is remarkably difficult to move the tool for illegal action from the timing sensor 152 to the coin sensor 116 within the predetermined time T2 after the predetermined time T1 elapses to cause the coin sensor 116 to output a detection signal DS2. When a tool for illegal action preliminarily attached with an access unit to such sensors as light emitters corresponding to the coin sensor 116 and the timing sensor 152 is used, it is unnecessary to move the tool for illegal action, but it is difficult to operate the bent tool for illegal action to position the respective light emitters to be accessible to the coin sensor 116 and the timing sensor 152 in the coin passage 106 and the coin detecting passage 114 which have been bent in a three-dimensional manner.

When a tool for illegal action relative to the coin sensor 116 and a tool for illegal action relative to the timing sensor 152 are constituted independently of each other, it is relatively easy to dispose the tool for illegal action to the timing sensor 152 at a position accessible to the timing sensor 152. However, it is extremely difficult to position the tool for illegal action relative to the coin sensor 116 at an access position to the coin sensor 116 because the tool for illegal action is bent in a three-dimensional manner. Accordingly, the present invention has features such that an illegal output indicating detection of a real coin C of the coin selector using the tool for illegal action can be prevented.

Figure 6:
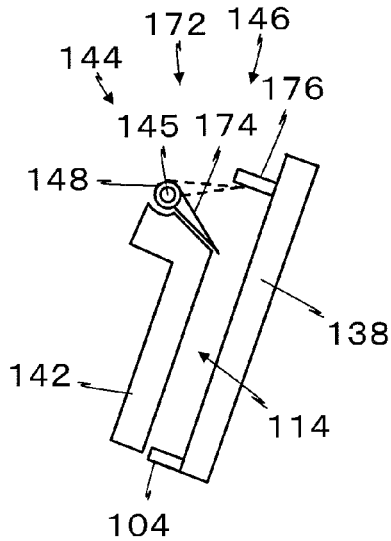
FIG. 6 is a sectional view of a second embodiment similar to FIG. 2.

FIG. 6 shows features according to a second embodiment similar to FIG. 2. With the second embodiment an upper face of the blocking body 174 of the pullback preventing unit 172 is formed in an inclined guiding face 146. As shown in FIG. 6, the blocking body 174 of the pullback preventing unit 172 is attached just above an upper end of the partition wall 142 so as to be pivotally moved to a fixed supporting shaft 145 and be ordinarily rotated due to its own weight. Rotation of the blocking body 174 is ordinarily blocked by an upper end of the partition wall 142 so that the blocking body 174 is positioned at an angle of about 45° to the second main body 138. A distal end of the blocking body 174 on the side of the second main body 138 is formed in a saw tooth shape. The blocking body 174 is ordinarily rotated in a clockwise direction in FIG. 6 due to its self-weight and is received by the upper wall of the partition wall 142 to remain stationary. A distal end of the blocking body 174 slightly projects to the coin detecting passage 114 in the stationary state. A stopper 176 is fixed to the second main body 138. The stopper 176 is disposed at a position where it does not block passage of a coin C, and it has a function of butting to the distal end of the blocking body 174 in a state that the blocking body 174 is positioned in an approximately horizontal state and holds the blocking body 174 in the state. When an illegal action using a string with connected coin is performed, since the coin passage 106 and the coin detecting passage 114 are displaced from each other, a string connected to a coin C is necessarily positioned in a recess of the saw teeth at the distal end of the blocking body 174. Accordingly, when the coin C is pulled up using the hanging string, the blocking body 174 is rotated in a counter-clockwise direction in FIG. 6 by the upper end of the coin C, and the distal end of the blocking body 174 is stopped by the stopper 176, so that such a state is held. Therefore, since the coin C cannot be further pulled up, the illegal action using the hanging string can be prevented.

A coin selector 300 according to the third embodiment includes a main body 302, a guide rail 304, a coin passage 306, a diameter sorting unit 310 which has a real/fake discriminating portion 308 disposed in an intermediate portion of the coin passage 306, a moving direction changing unit 312, a coin detecting passage 314 positioned downstream of the moving direction changing unit 312, a second main body 318 defining the coin detecting passage 314, a coin sensor 316 disposed in the coin detecting passage 314, a cancel unit 318, and a shutter unit 320.

The main body 302 will be explained with reference to FIG. 7 to FIG. 10. The main body 302 is attached with parts constituting the coin selector 300 and it has a function of guiding one face of a coin C. The main body 302 according to the present embodiment includes a guide wall 322 standing vertically, and a left side wall 324 and a right side wall 325 bent at a right angle from left and right end portions of the guide wall 322, and a recessed groove 328 extending in a vertical direction is formed by the guide wall 322, the left side wall 324, and the right side wall 325. A width and a height of the main body 302 are each 3.5 inches, so-called "de facto standard size". The coin selector 300 is attached to a game machine by hooking protrusions 332 projecting from the left side wall 324 and the right side wall 325 to attaching grooves (not shown) of the game machine.

Figure 11:
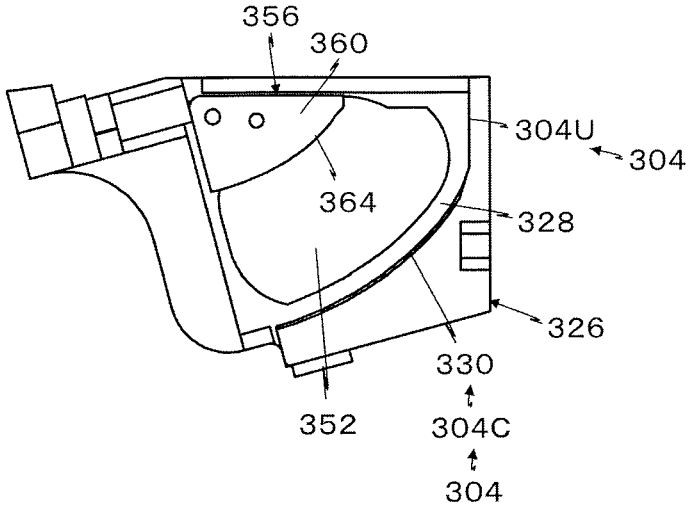
FIG. 11 is a back view of the third main body of the coin selector according to the third embodiment of the present invention.

The guide rail 304 will be explained with reference to FIG. 7 and FIG. 11. The guide rail 304 has the function where a coin C inserted in a slot 334 rolls to be guided in a predetermined direction. The guide rail 304 projects from a guide face 328 opposite to the guide wall 322 of the third main body rotatably attached to the main body 322 toward the guide wall 322 of the main body 302 in an amount slightly more than a thickness of a coin C, and it comprises an upper portion rail 304U standing approximately vertically and a curved portion 304C curved obliquely rightward in FIG. 7. The guide rail 304 can be made of material having wear resistance properties integrally with the third main body 326, but the wearing resistance property can be improved by disposing a slender metal plate 330 on a surface of the guide rail 304 like the third embodiment.

Figure 9:
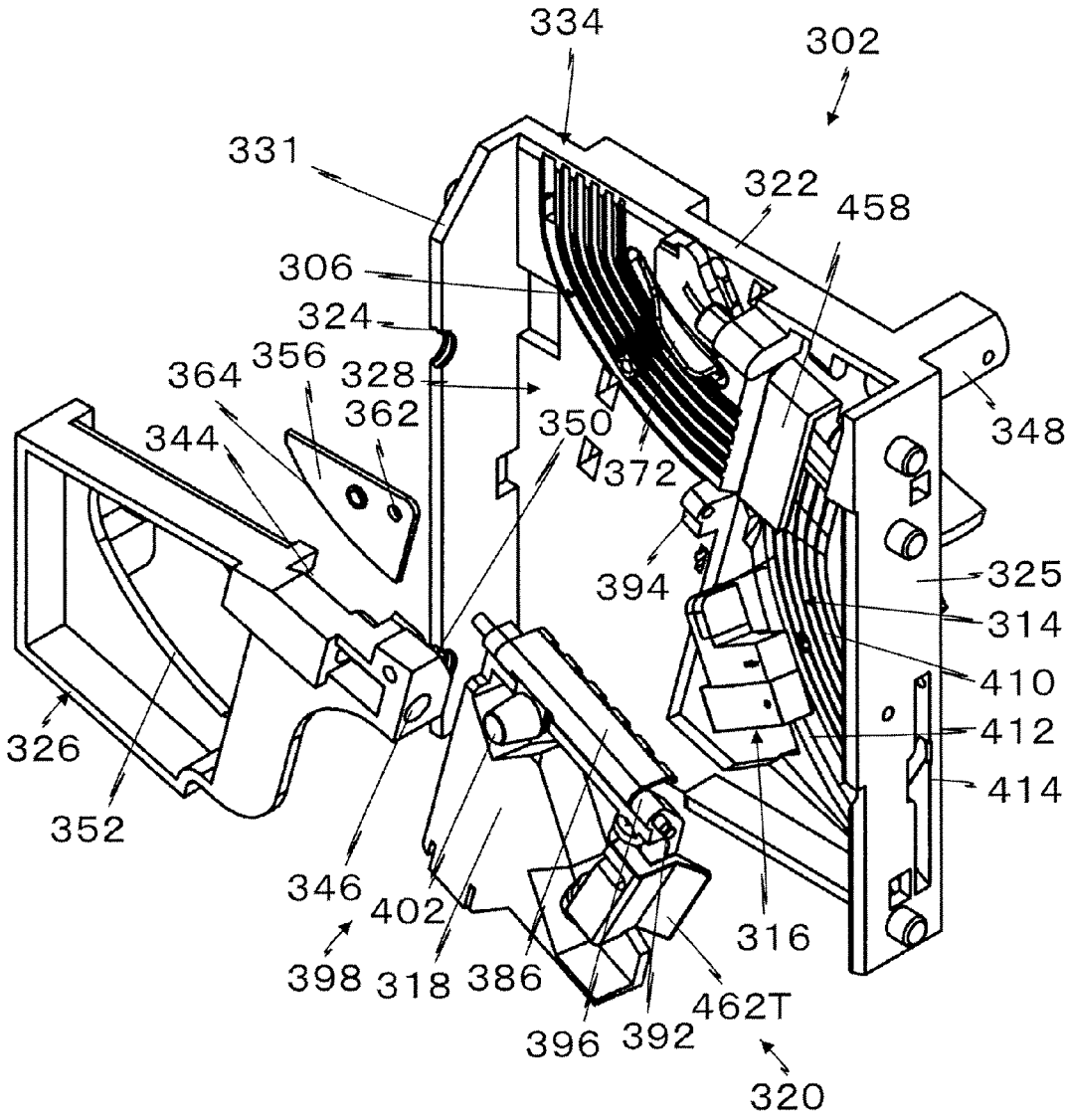
FIG. 9 is an exploded perspective view the coin selector according to the third embodiment of the present invention.
Figure 10:
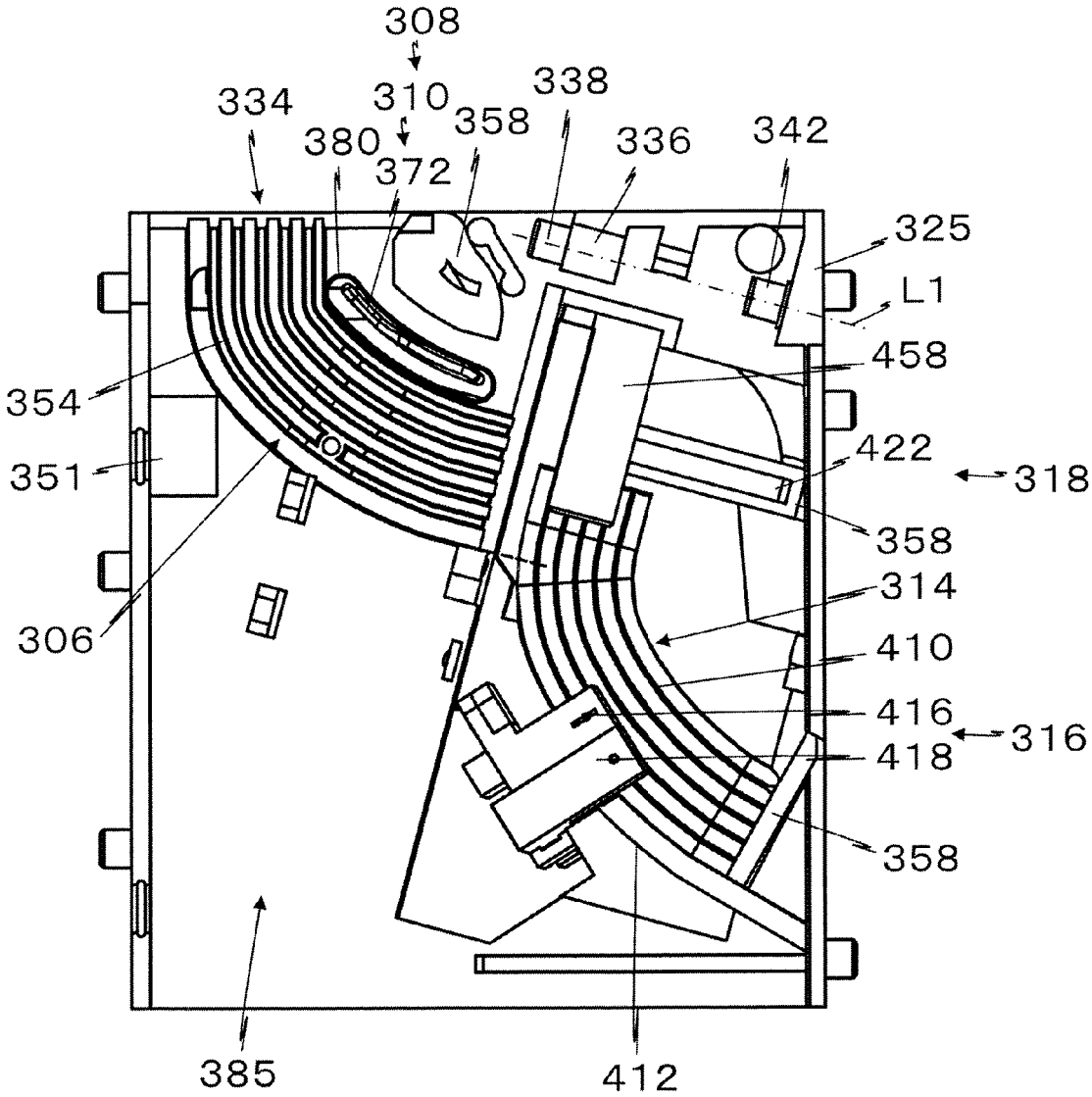
FIG. 10 is a front view of the coin selector according to the third embodiment of the present invention in a state that a second main body and a third main body have been detached.

The third main body 326 will be explained with reference to FIG. 10 and FIG. 11. The third main body 326 defines one face of the coin passage 306 and is provided with the guide rail 304, and it has a function of cancelling jammed coins C in the coin passage 306. In the third main body 326, first shaft 338 and a second shaft 342 projecting from a bearing 336 projecting in parallel laterally at an upper end portion of the guide wall 322 and the right side wall 325 are inserted into a first axial hole 344 (not shown) and a second axial hole 346 formed in the third main body 326. The first shaft 338 and the second shaft 342 are formed on the same axial line L1 inclined leftward and upwardly in FIG. 10. Thereby, the third main body 326 is rotatably attached between a position parallel to the guide wall 322 and a predetermined angle position where a lower end of the third main body 326 is separated from the guide wall 322. When the third main body 326 is attached to the main body 302, the third main body 326 is held obliquely along an inclined edge 331 of an upper end of the left side wall 324 to the main body 302, the first shaft 338 is inserted into the first axial hole 344, the second shaft 342 is inserted into the second axial hole 346, attaching to the respective shafts is performed by deviating in the lateral detection (in a right direction in FIG. 9), and the third main body 326 is rotated toward the guide wall 322. Thereby, fitting portions formed on the shaft 338 and the axial hole 344 are fitted to each other, so that the fitted state can be cancelled in the third main body 326. The third main body 326 receives moment about an axis thereof on a slope face 350 to be moved positioned laterally of the second axial hole 346 by a pusher (not shown) pushed by a spring (not shown) disposed in a cylinder 348 projecting behind the guide wall 322 and receives a predetermined biasing force toward the guide wall 322. An arc-shaped dropping opening 352 is formed in the center of the third main body 326 along the coin passage 306. A piece to be moved 353 extending from a lower end portion of the side of the left side wall 324 laterally and projecting from a through-hole 351 of the guide wall 322 is pushed toward the guide wall 322 so that the third main body 326 is rotated about the first shaft 338 and the second shaft 342 serving as fulcrums (a clockwise direction in FIG. 9). Thereby, since an end face of the guide rail 304 is separated from the guide wall 322 in a distance more than the thickness of a coin C and the guide rail 304 inclines downwardly, a coin C which cannot roll in the coin passage 306 drops from the guide rail 304 to be rejected.

The coin passage 306 has a function where a coin C inserted in the slot port 334 rolls on the guide rail 304 to be guided to the moving direction changing unit 312. The coin passage 306 has a rectangular sectional shape defined by the guide face 354 of the guide wall 322, the guide rail 304, the guide face 327 of the third main body 326, and the diameter sorting body 356, it is a passage curved rightward in FIG. 7, and it is positioned on the first plane. As shown in FIG. 9, the diameter sorting unit 356 is fixed to the third main body 326 so as not to be movable by fitting positioning holes 362 to positioning pins (not shown) projecting from the third main body 326 and using screws (not shown). A mounting 358 projecting from an upper end portion of the guide wall 322 toward the recessed groove 328 is formed to the third main body 326. The diameter sorting body 356 is formed such that its guide wall 360 is positioned within the same plane as the guide face 328 of the third main body 326 parallel to the guide wall 322 and its guide edge 364 has a similarity shape to the guide rail 304, and it is set to be separated from the guide rail 304 by a predetermined distance. In other words, when a real coin C rolls on the guide rail 304, an upper end side face of the real coin C is guided by the guide face 360 of the diameter sorting body 356, but a fake coin with a small diameter is not guided by the guide face 360 so that it can drop from the dropping opening 352. It is preferable that a plurality of ridges extending in a moving direction of a coin C is formed on the guide face 354 so that moving resistance of a coin C is reduced. Of course, ridges can be formed on the guide faces 328 and the 360. When coins C with different diameters are used, the diameter sorting body 356 is replaced by another diameter sorting body 356 different in distance between the guide edge 364 and the guide rail 304 from the former diameter sorting body 356. The diameter sorting body 356 is preferably made from wear-resistance material such as a metal plate because coins C rubs against the diameter sorting body 356.

Figure 12:
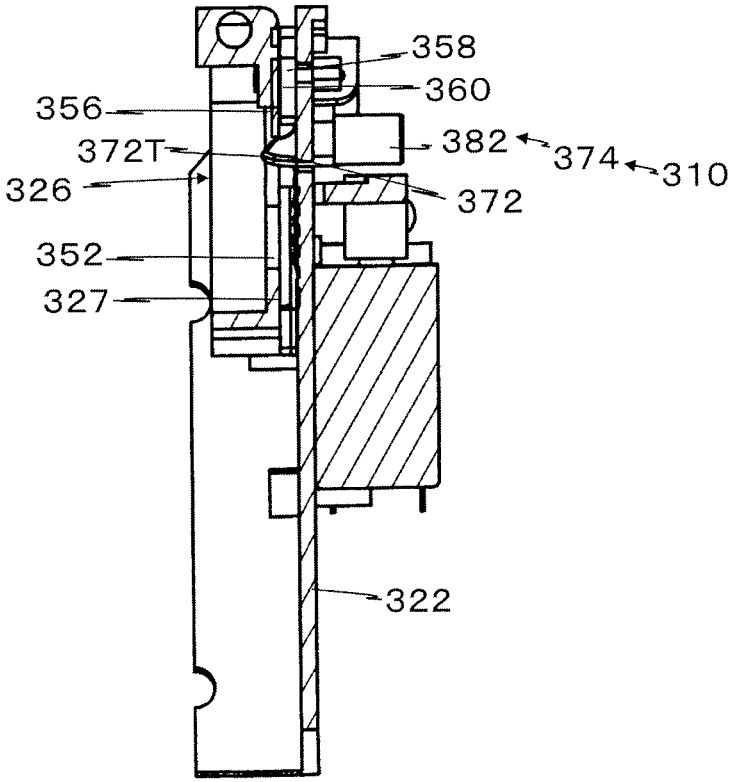
FIG. 12 is a sectional view of the coin selector, taken along line A-A in FIG. 7.

The diameter sorting unit 310 has a function of rejecting a small-diameter fake coin FC rolling on the coin passage 306. The diameter sorting unit 310 includes a deflecting body 372 and a biasing unit 374. In the deflecting body 372, both ends of an upper end shaft 378 thereof are rotatably attached to a third bearing 376L and a fourth bearing 376R provided at an upper end portion of a back face of the guide wall 322 (see FIG. 8). The deflecting body 372 is formed in a plate shape, it can advance to and retract from the coin passage 306 slightly nearer the guide rail 304 than the guide edge 364 of the diameter sorting body 356 through an arc-shaped opening 380 of the guide wall 322, and it is curved corresponding to a curvature of the coin passage 306. As shown in FIG. 7, a small diameter coin SC can be excluded from the coin passage 306 rapidly by pushing an upper end side face of the small diameter coin SC near the diameter sorting body 356 in a lateral direction by the deflecting body 372. Since a distal end of 372T (see FIG. 12) of the deflecting body 372 is inclined to the coin passage 306, when the deflecting body 372 is positioned in the coin passage 306, a coin C inserted in the slot port 334 is guided laterally and receives a pushing-out force from the coin passage 306. A first weight 382 serving as a first biasing body 374 is attached on a back face of the guide wall 322 of the deflecting body 372, and the deflecting body 372 receives moment about the shaft 378 serving as a fulcrum in a clockwise direction in FIG. 12 by a predetermined force. Thereby, the deflecting body 372 ordinarily projects in the coin passage 306 with a predetermined moment. Therefore, when a real coin C rolls along the guide rail 304, since an upper end side face thereof is guided by the guide face 360 of the diameter sorting body 356 and the guide face 328 of the third main body 326, the real coin C moved in the coin passage 306. Since the first biasing body 374 is required to only apply a biasing force to the deflecting body 372, a spring may be used instead of the weight. However, when a weight is used, variations among individual weights are small, so that it is desirable to use the weight for quality control. When a small-diameter fake coin SC rolls on the guide rail 304, since an upper end side face thereof is not guided by the guide face 360 of the diameter sorting body 356, is caused to fall down in the drop opening 352 and is caused to drop from the guide rail 304 to be rejected through a reject passage 385.

Figure 13:
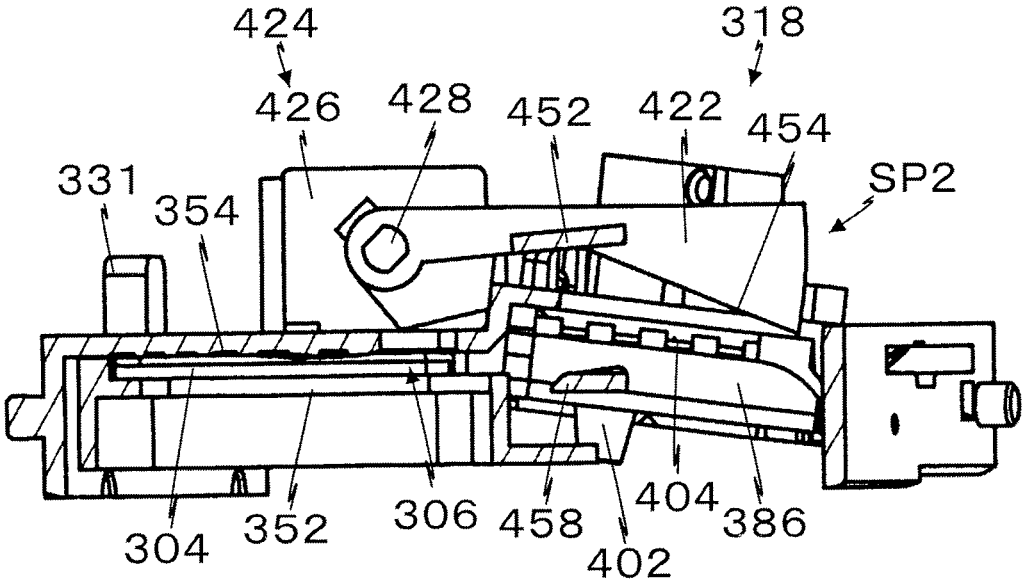
FIG. 13A is sectional view of the coin selector, taken along line B-B in FIG. 7, showing the coin selector at a receiving time of a coin.
FIG. 13B is sectional view of the coin selector, taken along line B-B in FIG. 7, showing the coin selector at a cancelling time of a coin.
Figure 13:
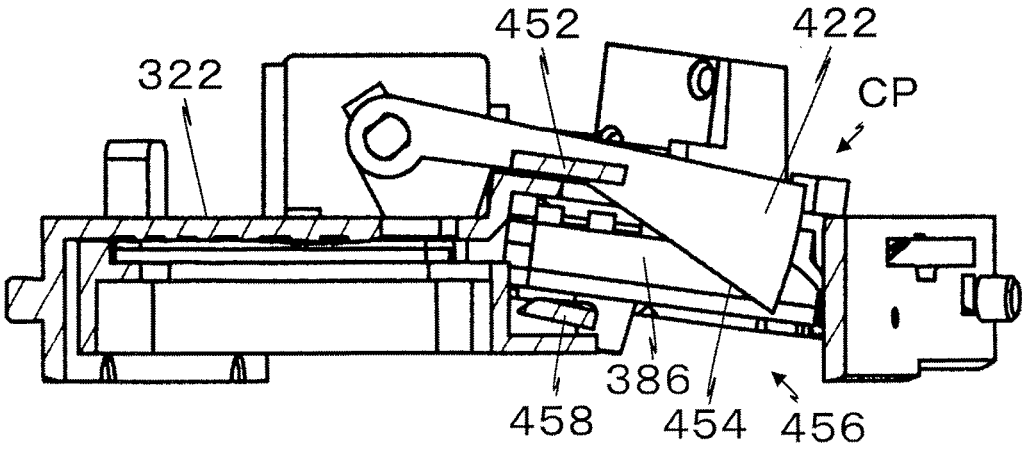
Figure 16:
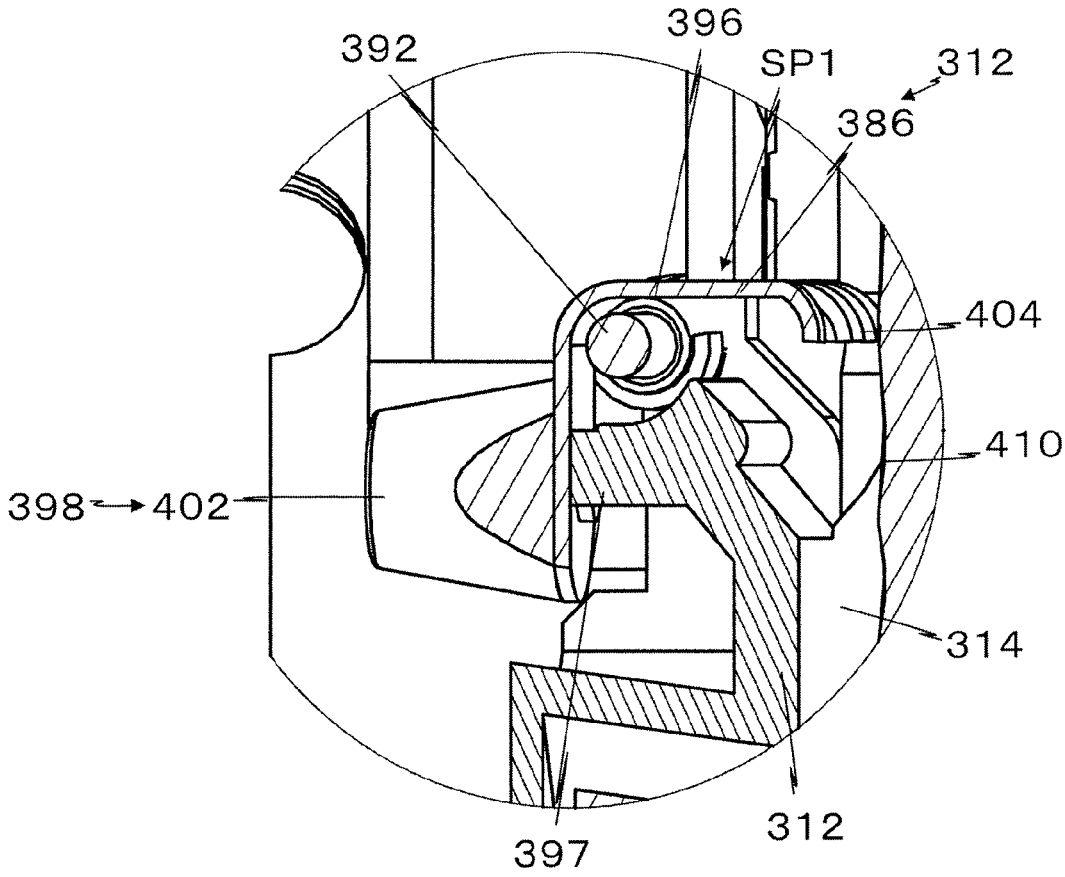
FIG. 16 is a sectional view of the coin selector, taken along line E-E in FIG. 7.
Figure 17:
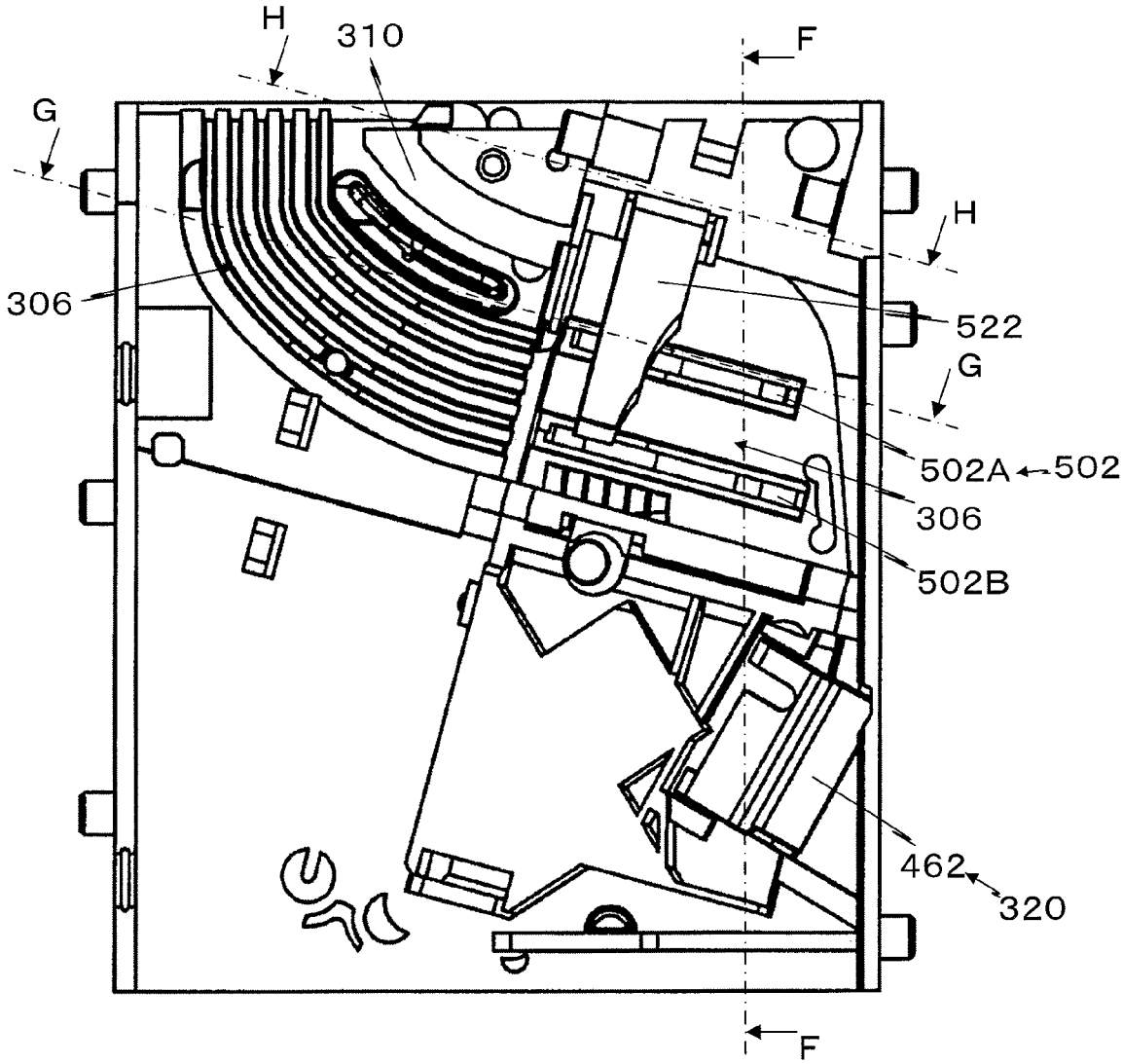
FIG. 17 is a front view of a coin selector according to a fourth embodiment of the present invention, where a second main body and a third main body have been detached.
Figure 18:
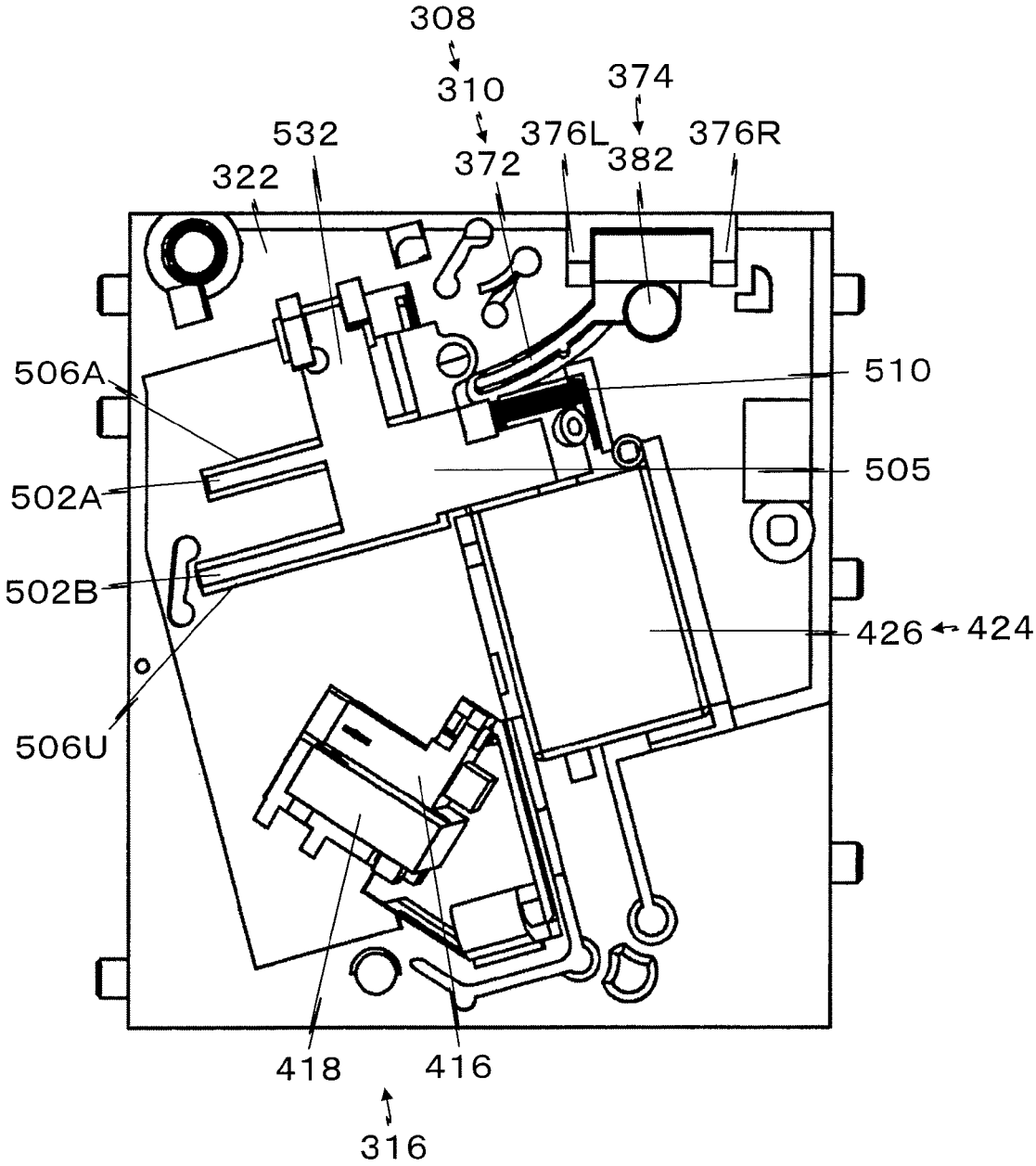
FIG. 18 is a back view of the coin selector according to the fourth embodiment of the present invention.
Figure 19:
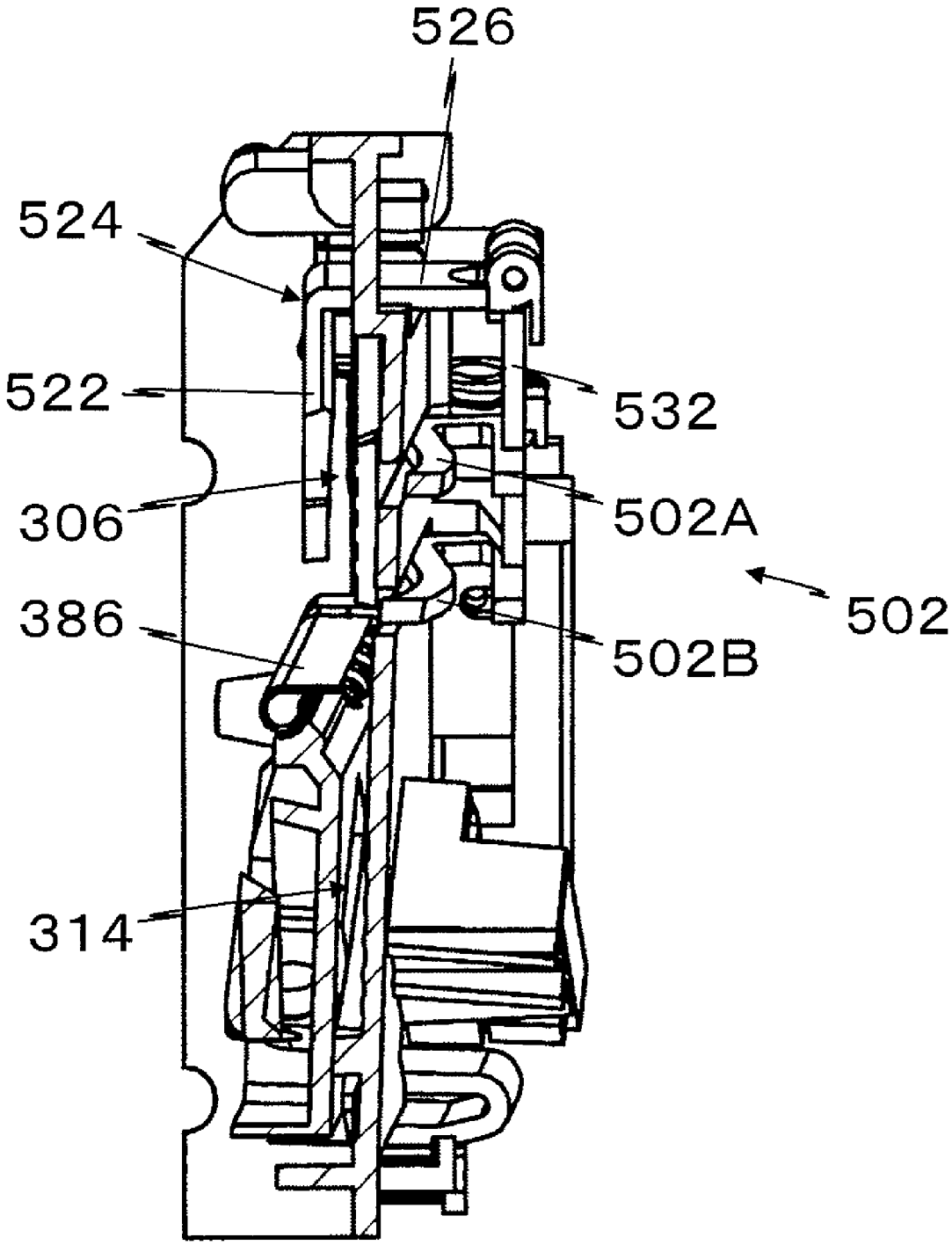
FIG. 19 is a sectional view of the coin selector, taken along line F-F in FIG. 17.

The moving direction changing unit 312 is disposed downstream of the coin passage 306, and it has a function of changing a moving direction of a coin C to a different direction to the coin passage 306. According to the third embodiment, a coin C is guided to the coin detecting passage 314 disposed so as to be displaced to the coin passage 306 by the moving direction changing unit 312. As described below, the coin detecting passage 314 is displaced rearward to the coin passage 306 (on the side of the back face of the guide wall 322), and it is positioned within the second plane inclined obliquely. The moving direction changing unit 312 includes a guiding body 386. The guiding body 386 is formed in a slender rectangular plate shape, it is disposed on an extension line of the guide rail 304, it is inclined rightward downwardly in FIG. 7, and one end of a front face end portion thereof is rotatably attached to a supporting shaft 392 which is a pivot shaft via a bearing (not shown). The supporting shaft 392 is attached to a fifth bearing 394 projecting from the guide wall 322 laterally and a sixth bearing 396 projecting near the right side wall 325. As shown in FIG. 13, the supporting shaft 392 is disposed at an obtuse angle to the coin passage 306 in plan view. A second weight 402 which is a second biasing body 398 is fixed to the opposite side of the supporting shaft 392 of the guide body 386. Thereby, the guiding body 386 receives counterclockwise moment about the supporting shaft 392 in FIG. 16, rotation of the second weight 402 is blocked at a back face thereof by a stopper 397 formed on the second main body 318, and the guiding body 386 is held at a standby position SP1 forming an extension plane of the guide rail 304. The second biasing body 398 can also be replaced by a biasing unit such as a spring, but it is desirable to use a weight because individual variations are small among weights. A distal end of the guiding body 386 is formed with rectangular saw teeth 404, and setting is made such that, when the guiding body 386 is positioned at the standby position SP1, a distance between the guide wall 322 and the distal end of the guiding body 386 is smaller than the thickness of the real coin C, so that the coin C cannot pass between the guide wall 322 and the distal end of the guiding body 386. When the coin C rolling in the coin passage 306 rides on the guiding body 386, the guiding body 386 is rotated in a clockwise direction in FIG. 16 due to the weight of the coin C, so that the guiding body 386 is inclined downwardly in a guiding position toward the guide wall 322. When the guiding body 386 is inclined in said guiding position, a distance between the distal end thereof and the guide wall 322 becomes considerably larger than the thickness of the real coin C. Thereby, the coin C slides on the guiding body 386 to drop in the coin detecting passage 314. At this time, the coin C strikes against the guiding body 386 at an obtuse angle. Therefore, the guiding body 386 is inclined downwardly so that it becomes a gradually rising state to the coin C and it spins a rear end of the coin C to the side of the guide wall 322. Thereby, even if the following coins C flow next to the preceding coin in a continuous manner they can move in the moving direction changing unit 312 without causing jamming.

Next, the coin detecting passage 314 will be explained with reference to FIG. 9 and FIG. 10. The coin detecting passage 314 has a function of guiding a real coin C whose moving direction has been changed by the moving direction changing unit 312 in a predetermined direction, where the real coin rolling in the coin detecting passage 314 is detected. The coin detecting passage 314 is disposed downstream of the coin passage 306 and it is disposed on as approximately vertically standing plane different from the coin passage 306. The coin detecting passage 314 is disposed within an approximately vertically standing second plane displaced on the side of the guide wall 322 to the coin passage 306. In the third embodiment, as shown in FIG. 9, the coin detecting passage 314 is disposed within an approximately vertically standing plane inclined to the coin passage 306. The moving direction changing unit 312 is disposed at an upper end portion of the coin detecting passage 314. The coin detecting passage 314 is defined by a detecting passage guide wall 410, an arc-shaped detecting portion guide rail 412 projecting from the detecting passage guide wall 410 laterally, and an inner face 413 of the second main body 318, it is curved rightward downwardly, as shown in FIG. 9, and a downstream end thereof is a vertically long slit-like exit 414 opened to the right side wall 325. The detecting passage guide wall 410 is formed so as to be positioned within the plane inclined to the coin passage 306 up to the coin sensor 316 described later and positioned within the same plane as the guide wall of the coin passage 306 just before the shutter unit 320 described later. The coin detecting passage 314 may be formed so as to be parallel to the coin passage 306 without being inclined to the coin passage 306.

Next, the coin sensor 316 will be explained with reference to FIG. 9 and FIG. 10. The coin sensor 316 has a function of detecting a real coin C rolling in the coin detecting sensor 314. The coin sensor 316 may be one of a transmission type photoelectric sensor, a reflection type photoelectric sensor, a magnetic sensor, a contact sensor, and the like, and a plurality of sensors are preferably disposed. This is because an illegal action performed by insertion of a tool for illegal action from the exit 414 can be discriminated by discriminating an output order of detection signals or the like. In the third embodiment, the coin sensor 316 comprises a plurality of sensors with different systems of a transmission photoelectric sensor 416 and a magnetic sensor 418. When sensors of different systems are used, since an illegal action must be performed such that erroneous detections occur corresponding to the different sensors, such a merit can be obtained that an illegal action is made difficult. The transmission photoelectric sensor 416 disposed on the upstream side of the magnetic sensor 418 has a constitution that a light emitting portion and a light receiving portion are disposed such that the coin detecting passage 314 is interposed therebetween. The magnetic sensor 418 disposed on the downstream side of the transmission photoelectric sensor 416 adjacent thereto has a constitution that a coil is disposed such that the coin detecting passage 314 is interposed between the coin and the magnetic sensor 418. The transmission photoelectric sensor 416 and the magnetic sensor 418 are disposed in a positional relationship maintaining a detection state of a coin C when advance is stopped in a state that the guiding body 386 is pulled up by the coin C suspended by a string to form an extension plane of the guide rail 304.

Figure 8:
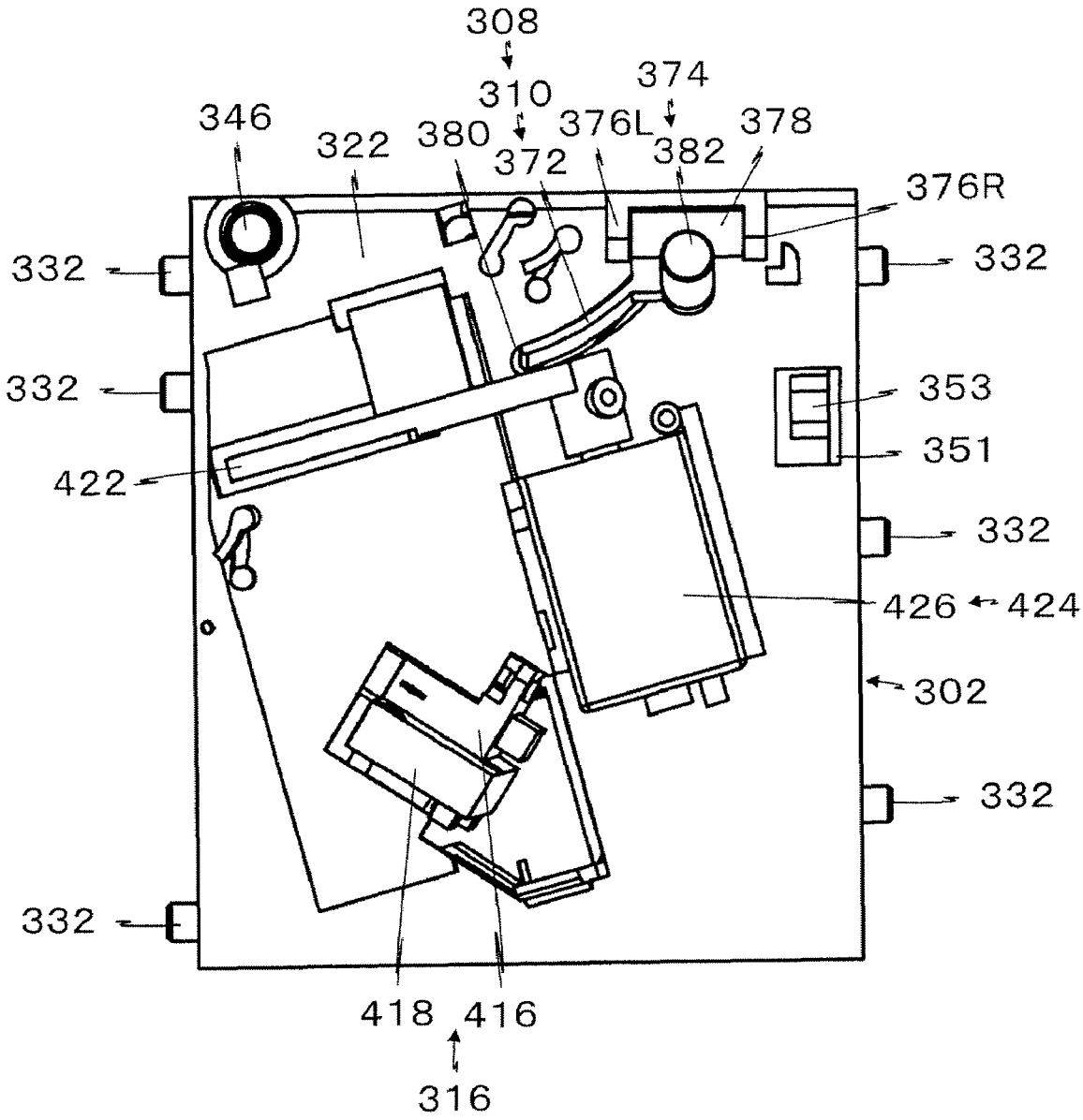
FIG. 8 is a back view of the coin selector according to the third embodiment of the present invention.

Next, the cancel unit 318 will be explained with reference to FIG. 8 and FIGS. 13A and 13B. The cancel unit 318 has the function of performing cancelling such that a real coin C that has passed through the real/fake discriminating unit 308 does not advance to the coin detecting passage 314. In the third embodiment, the cancel unit 318 includes a cancel body 422 and an electromagnetic actuator 424. The cancel body 422 is fixed to an output shaft 428 of a rotary solenoid 426 which is the electromagnetic actuator 424 properly excited to the coin passage 306 above the guiding body 386. When the rotary solenoid 426 is put in a demagnetized state, the cancel body 422 is rotated in a clockwise direction as shown in FIG. 13B by repulsion force of magnetic incorporated in the cancel body 422. Thereby, a protrusion 452 formed integrally with the cancel body 422 abuts on a back face of the guide wall 322 so that a guide edge 454 of the cancel body 422 is held at a cancel position CP crossing the coin passage 306. Therefore, a coin C rolling on the guide rail 304 is deflected laterally by the guide edge 454 to drop from the guiding body 386. At this time, the coin C rides on the guiding body 386 but the coin C is deflected to the side of the supporting shaft 392 of the guiding body 386 by the guiding edge 454 before riding on the guiding body 386, so that the guiding body 386 is held at a standby position SP1 without rotating the guiding body 386 against its moment. Therefore, the coin C drops from the guiding body 386 to be cancelled through the cancel passage 456. A moving direction changing portion guiding body 458 following the protrusion 452 is formed. The moving direction changing portion guiding body 458 is disposed laterally on the opposite side of the coin passage 306 to the cancel body 422 above the guiding body 386. When the cancel body 422 is positioned at a standby position SP2, the moving direction changing portion guiding body 458 is laterally positioned on the coin passage 306, and guides the coin C without dropping from the guiding body 386. When the cancel body 422 is positioned at a cancel position CP, the moving direction changing portion guiding body 458 is separated from the coin passage 306 and it does not obstruct the coin C dropping from the guiding body 386.

Figure 14:
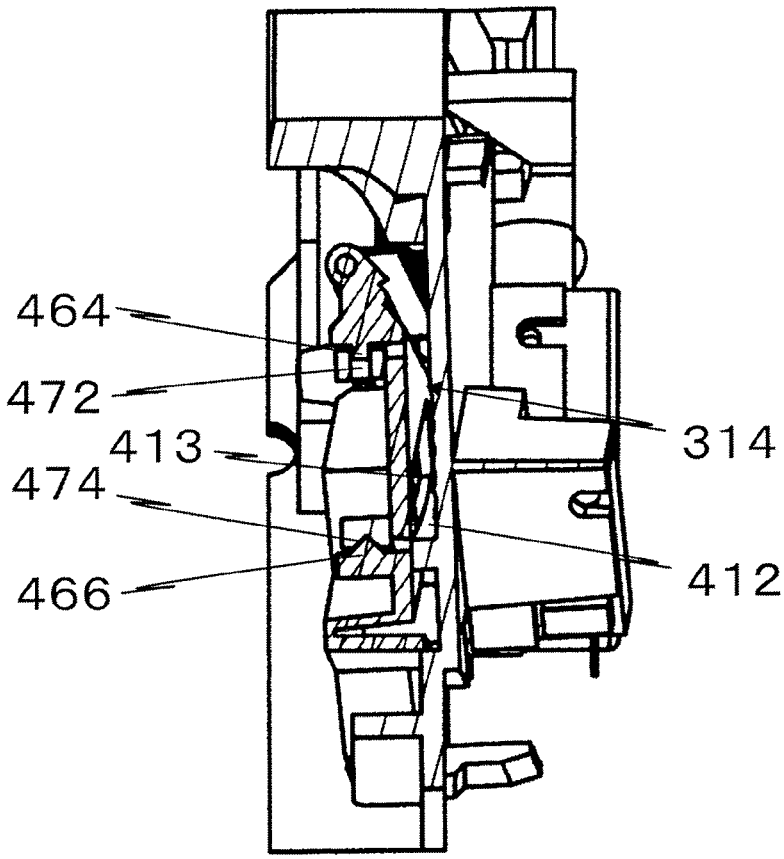
FIG. 14 is a sectional view of the coin selector, taken along line C-C in FIG. 7.
Figure 15:
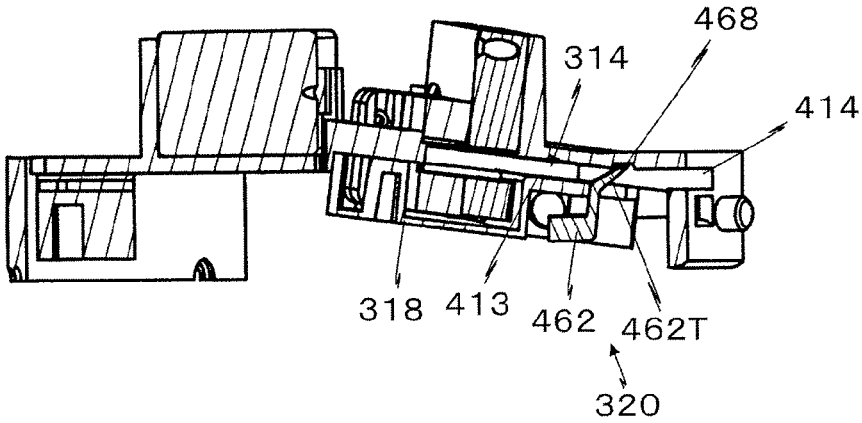
FIG. 15 is a sectional view of the coin selector, taken along line D-D in FIG. 7.

Next, the shutter unit 320 will be explained with reference to FIGS. 7, 9, 14, and 15. The shutter unit 320 has the function of blocking insertion of a tool for illegal action from the exit 414 to the coin detecting passage 314. The shutter unit 320 in the third embodiment includes a shutter body 462. The shutter body 462 is formed in a plate shape with a crank shape in plane view (see FIG. 15), and it can advance to and retract from in the coin detecting passage 314 between the coin sensor 316 and the exit 414. As shown in FIG. 14, the shutter body 462 is rotatably attached to a seventh bearing 464 and an eighth bearing 466 projecting to a surface side of the second main body 318. The seventh bearing 464 is a downward cylindrical shape, and it is inserted into an axial hole 472 formed at an upper end portion of the shutter body 462. The eighth bearing 466 is a conical protrusion, and it is fitted into a conical axial hole 474 formed at a lower end portion of the shutter body 462. Since a conical angle of the conical protrusion of the eighth bearing 466 is formed to be smaller than a conical angle of the conical axial hole 474, a rotational resistance of the shutter body 462 is small.

Figure 7:
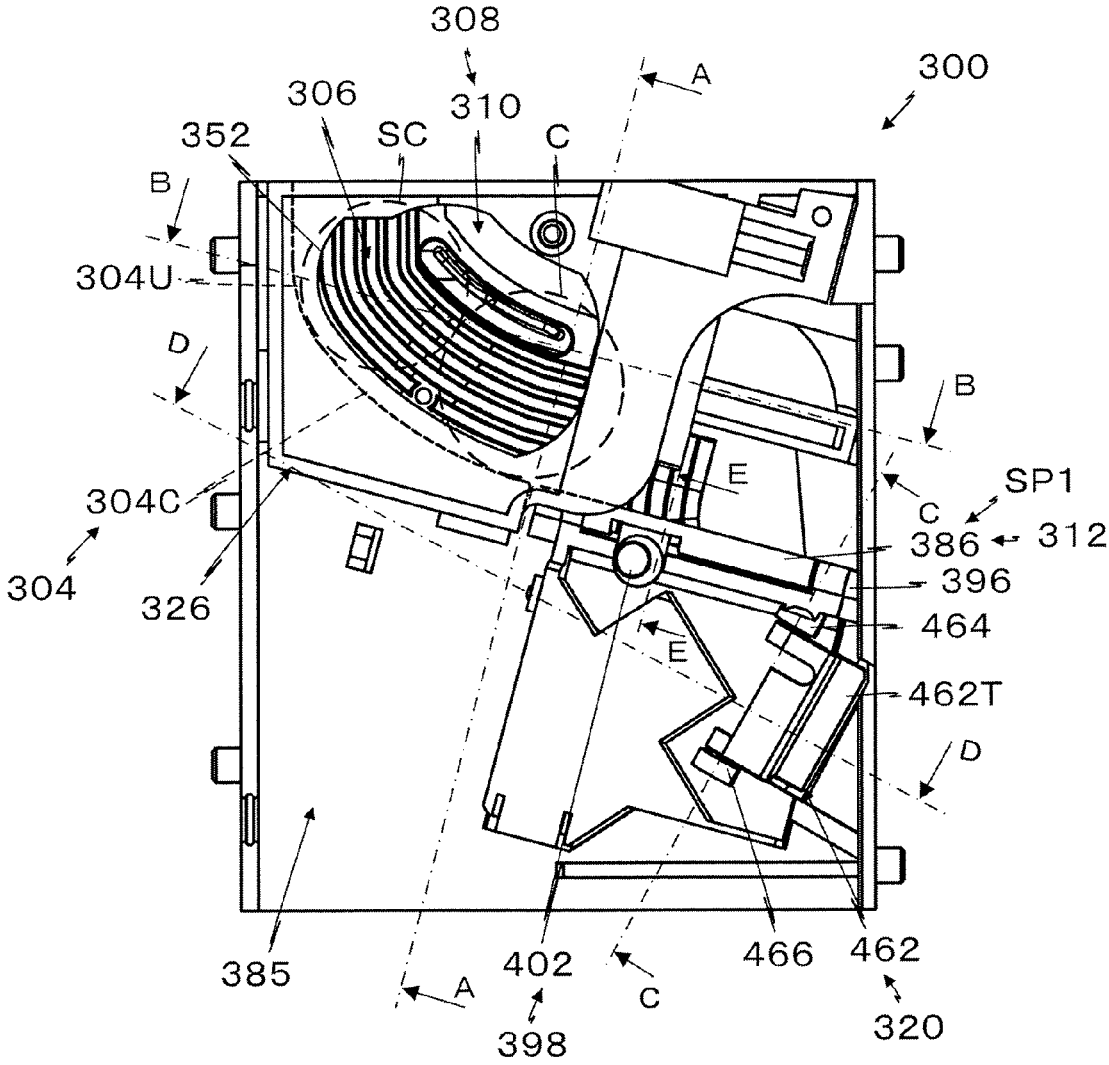
FIG. 7 is a front view of a coin selector according to a third embodiment of the present invention.

As shown in FIG. 7, an axial line of the seventh bearing 464 and the eighth bearing 466 is arranged so as to form a right angle to an extension direction of the coin detecting passage 314 in front view. Therefore, as shown in FIG. 7, the shutter body 462 is obliquely attached to the main body 303 and it receives moment about the axial line. The shutter body 462 is set so as to be rotated in a counterclockwise direction in FIG. 15 due to its self-moment. In other words, a distal end 462T of the shutter body 462 is ordinarily rotated to the side of the coin detecting passage wall 410 to contact with a bottom of a receiving groove 468 formed in the coin detecting passage wall 410 by a predetermined force. At this time, the distal end 462T is inclined toward a downstream side in a moving direction of a coin in the coin detecting passage 314. Thereby, when a coin C rolls in the coin detecting passage 314, the shutter body 462 is pushed by the coin C to be rotated in a clockwise direction in FIG. 15, so that the coin C can move to the exit 414. When a tool for illegal action is inserted from the exit 414, the shutter body 462 is pushed in a counterclockwise direction in FIG. 15, so that further advance of the tool for illegal action is prevented by the shutter body 462.

Next, the operation of the third embodiment will be explained. When a game machine attached with the coin selector 300 is not in a state for receiving a coin C, since the rotary solenoid 426 is put in a demagnetized state, the cancel body 422 is rotated in a clockwise direction by attraction of the incorporated magnet so that the cancel body 422 is held at the cancel position CP where it has advanced to the coin passage 306. When a real coin C is inserted in the slot 334, the coin C rolls on the guide rail 304 while both side faces thereof are being guided by the guide face 354, the main body 326, and the diameter sorting unit 356, and it reaches the cancel body 422. The coin C is guided by the guide edge 453 of the cancel body 422 crossing the coin passage 306 before it rides on the guiding body 386 to be deflected to the side of the supporting shaft 392 of the guiding body 386 so that the coin C drops in the cancel passage 456.

Next, a case that the coin selector 300 is put in a state for receiving a coin C will be explained. In other words, as shown in FIG. 13A, the rotary solenoid 426 is excited so that the cancel body 422 is put in a retracted state from the coin passage 306. First, a case that a real coin C has been inserted will be explained. The real coin C rolls on the guide rail 304 to reach the real/fake discriminating portion 310. In the diameter sorting unit 308 which is the real/fake discriminating portion 310, the coin C receives a laterally deflecting force by the distal end 372T of the deflecting body 372 crossing the coin passage 306. However, since an upper end portion side face of the real coin C is guided by the guide face 360 of the diameter sorting unit 356 and a lower end portion side face thereof is guided by the guide face 328 of the third main body 326, the coin C passes through the real/fake discriminating portion 310 to reach the guiding body 386 without dropping. The guiding body 386 receives moment in a clockwise direction of the supporting shaft 392 in FIG. 9 by the real coin C which has ridden on the guiding body 386 to rotate. Therefore, the real coin C slides on the guiding body 386 to move to the coin detecting passage 314 disposed so as to be displaced laterally to the coin passage 306 and roll on the detecting portion guide rail 412. Since the coin C rolling on the detecting portion guide rail 412 interrupts transmission light, the photoelectric sensor 416 outputs a detection signal and immediately thereafter the magnetic sensor 418 also detects a metal-made coin to output a detection signal. The detection signals are used for counting real coins C or the like. Further, the real coin C pushes the shutter body 462 to rotate the same in a clockwise direction in FIG. 13 and it passes through the shutter unit 320 to be taken in the game machine from the exit 414.

Next, a case that a small-diameter fake coin SC has been inserted will be explained. In the real/fake discriminating unit 310, an upper end side face of a small-diameter fake coin SC is not guided by the diameter sorting body 356. Therefore, since an upper end portion of the small-diameter fake coin SC is pushed out to the drop opening 352 by a pushing force of the deflecting body 372 acting in a lateral direction of the coin C, the coin C turns cartwheels to drop from the guide rail 304 to the reject passage 385 to be rejected.

Next, a case that a large-diameter fake coin has been inserted will be explained. A large-diameter fake coin is sandwiched between a periphery of the mounting portion 358 and the guide rail 304 so that it cannot roll on the coin passage 306. In this case, the third main body 326 is rotated about the first shaft 338 and the second shaft 342 by pushing and moving the piece to be moved 353. Thereby, since a clearance larger than the thickness of the coin C is formed between the end face of the guide rail 304 of the third main body 326 and the guide face 354 and an upper face of the guide rail 304 is inclined downwardly, the coin C which cannot move drops to be rejected.

Next, a case that a tool for illegal action has been inserted in the slot 334 will be explained. Even if a tool for illegal action is inserted along the coin passage 306, it is necessary to advance the tool for illegal action into the coin detecting passage 314 positioned on the different plane disposed so as to displaced from the plane on which the coin passage 306 is disposed. However, it is difficult to advance the tool for illegal action to the displaced coin detecting passage 314 in a narrow range and the tool for illegal action cannot be advanced substantially. Therefore, it is impossible to perform an illegal action to the coin sensor 316 by using a tool for illegal action inserted from the slot 334. Even if turning-ON and turning-OFF of the coin sensor 316 are tried by utilizing a real coin C connected with a string, when the coin C is pulled up, the coin is caught by the guiding body 386 to rotate the guiding body 386 in a counterclockwise direction in FIG. 16. Thereby, the guiding body 386 can be rotated to a plane position on extension of the guide rail 304. Therefore, since the photoelectric sensor 416 and the magnetic sensor 418 are not turned OFF, an illegal action cannot be performed even by a coin hung by a string.

Next, a case that a tool for illegal action has been inserted into the exit 414 will be explained. When a tool for illegal action has been inserted into the exit 414, the shutter body 462 is pushed by the tool and the distal end thereof is rotated only in a direction in which it pushes the guide wall. Therefore, an illegal action to the coin sensor 316 cannot be conducted by the tool for illegal action inserted into the exit 414.

Since the fourth embodiment has a constitution that the cancel body 422 and the moving direction changing portion guiding body 458 have been modified in the third embodiment, only a modified portion will be explained.

Figure 20:
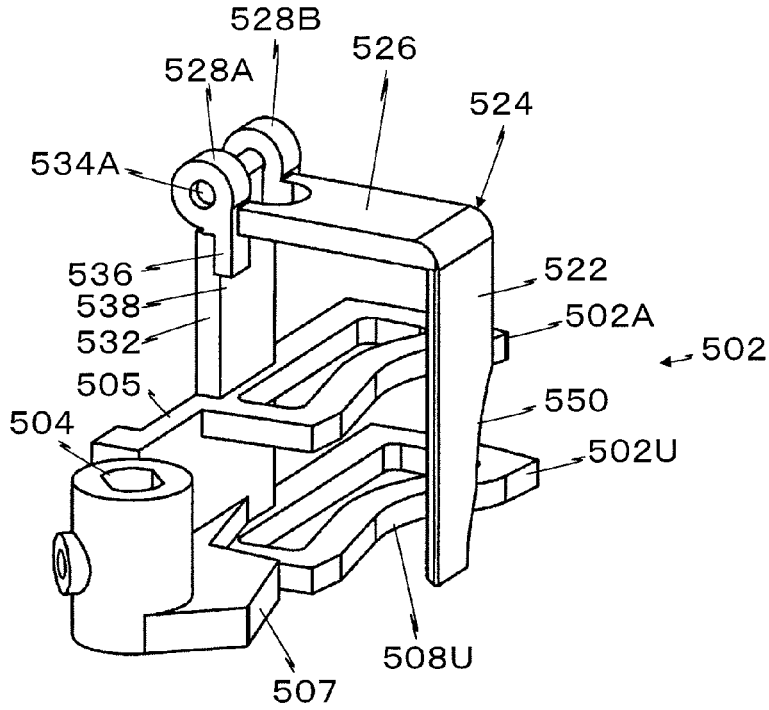
FIG. 20 is a perspective view of a cancel body and a moving direction changing portion guide body of the coin selector according to the fourth embodiment of the present invention, viewed from the above on an upstream side in a coin moving direction.
Figure 21:
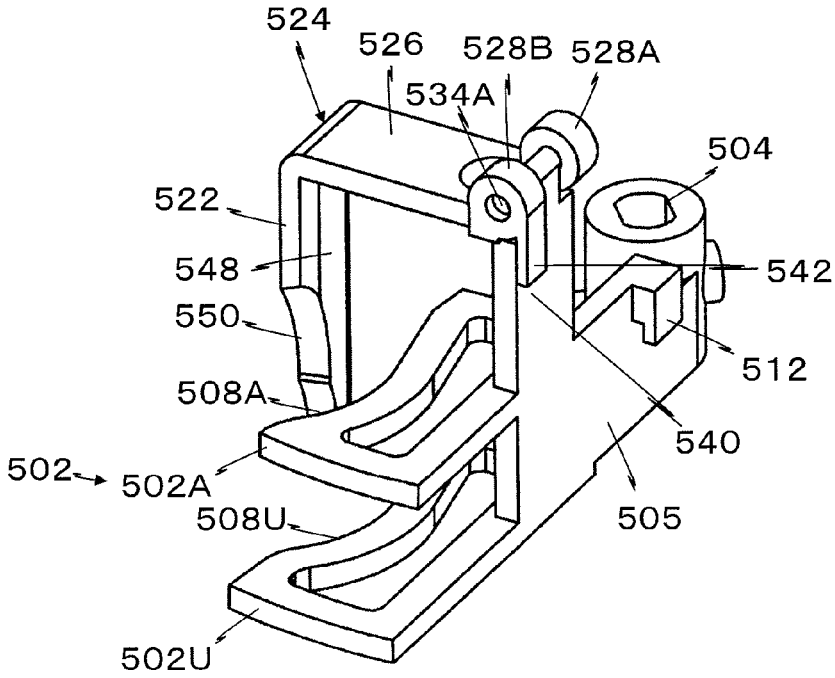
FIG. 21 is a perspective view of the cancel body and the moving direction changing portion guide body of the coin selector according to the fourth embodiment of the present invention, viewed from the above on a downstream side in the coin moving direction.
Figure 22:
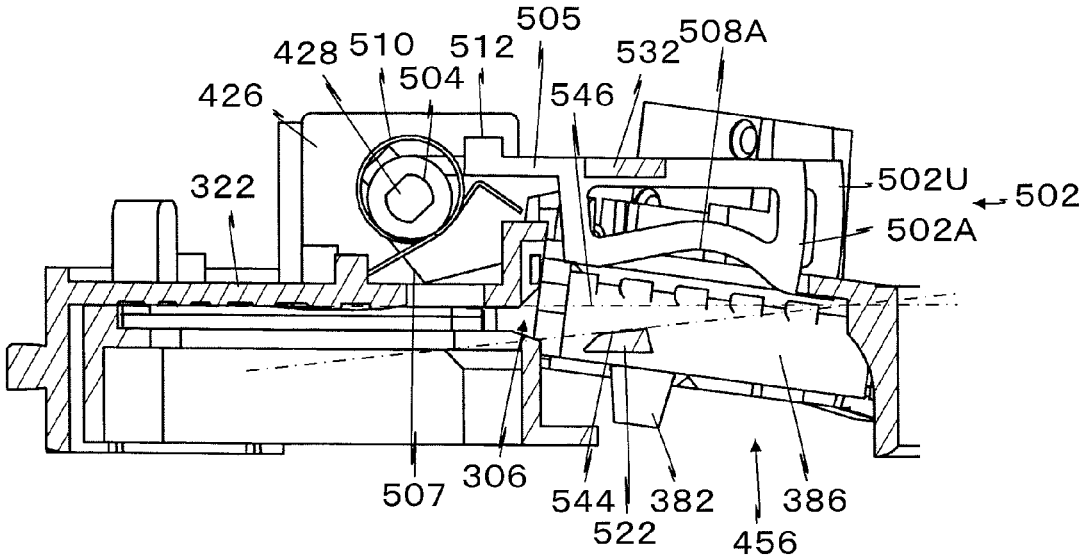
FIG. 22 is a sectional view of the coin selector, taken along line G-G in FIG. 17.

In the cancel body 502 in the fourth embodiment, the output shaft 428 of the rotary solenoid 426 is inserted into a boss hole 504 at one end and it is fixed by a set screw (not shown). The cancel body 502 has a plate-shaped base portion 505 on the side of the boss hole 504, and an upper cancel piece 502A and a lower cancel piece 502U are provided in a relationship of an upper part and a lower part on a portion of the cancel body 502 extending from an intermediate portion to a distal end at a predetermined interval narrower than the diameter of the coin C. It is preferable that the interval is about ⅓ of the diameter of the coin C in order to push one face of the coin C reliably. The upper cancel piece 502A and the lower cancel piece 502U have predetermined lengths along the coin passage 306 above the guiding body 386 along the coin passage 306, and they are provided so as to freely advance to and retract from the coin passage 306 from an upper through-hole 506A and a lower through-hole 506U formed in the guide wall 322. An upper guide edge 508A and a lower guide edge 508U of the upper cancel piece 502A and the lower cancel piece 502U which guide a coin C are formed in an arc shape, as shown in FIG. 20 to FIG. 22, and they are formed such that, when they project into the coin passage 306, they guide the coin C to the cancel passage 456 along a gentle curve. The upper guide edge 508A and the lower guide edge 508U are for guiding a coin C to the cancel passage 456 smoothly.

According to the fourth embodiment, the cancel body 502 is biased so as to be rotated in a clockwise direction (a projecting direction into the coin passage 306) in FIG. 22 by a spring force of a helical spring 510 disposed around a boss in addition to a repulsion force of the magnet incorporated in the rotary solenoid 426. The helical spring 510 is for cancelling a real coin C reliably by increasing a moving velocity of the cancel body 502 into the coin passage 306. In the fourth embodiment, the cancel body 502 is rotated in a counterclockwise direction in FIG. 22 by excitation of the rotary solenoid 426, a first engaging portion 512 formed on a back face of the base portion 505 is engaged with a stopper (not shown) formed integrally with the guide wall 322, and the moving direction changing portion guiding body 522 is held at one side of the coin passage 306 described below. When the rotary solenoid 426 is demagnetized, the cancel body 502 is rotated in a clockwise direction in FIG. 22 by a repulsion force of the incorporated magnet and the spring force of the spring 510, an engaging portion 507 formed laterally of the boss portion is engaged with a stopper (not shown) on a back face of the guide wall 322, so that the upper cancel piece 502A and the lower cancel piece 502U are held at the cancel position CP where they have projected into the coin passage 306 (see FIG. 25).

The moving direction changing portion guiding body 522 is a downward vertical standing portion of an inverted L-shaped body 524. Bearings 528A and 528B formed at an end portion of a horizontal portion 526 of the inverted L-shaped body 524 at a predetermined interval are rotatably fitted on shafts 534A and 534B formed sideways at an upper end of a stay 532 vertically standing from the base portion 505. Since the inverted L-shaped body 524 generates self-moment without requiring a weight or a spring, it is preferable that the inverted L-shaped body 524 is made from resin or it is manufactured by working resin to obtain a predetermined biasing force. A guide position engaging piece 536 extending from a bearing 528A to a front face side of the stay 532 projects. The guide position engaging piece 536 is stopped by a stopper face 538 on the side of the coin passage 306 of the stay 532, and it is held at a guide position GP parallel with the stay 532. A rotation restricting piece 542 extends from the bearing 528B to a back face side of the stay 532, the rotation restricting piece 542 is engaged with a stopper face 540 on the back face of the stay 532 at a position where the inverted L-shaped body 534 has been rotated a predetermined angle, so that rotation of the inverted L-shaped body 534 is stopped. In other words, when the moving direction changing portion guiding body 522 is separated from the cancel pieces 502A and 502U by a predetermined distance, movement of the moving direction changing portion guiding body 522 is stopped by the rotation restricting piece 542 (shown by a two-dotted chain line in FIG. 23). When the cancel body 502 is put in a receivable state of a coin C, namely, when the rotary solenoid 426 is excited and the engaging portion 512 is engaged by the stopper (not shown) (a state shown in FIG. 22), a guide face 544 of the moving direction changing portion guiding body 522 is disposed on the side of the anti-guide wall 322 of the coin passage 306. The guide face 544 is formed to have an acute angle to the coin passage 306 toward the front in the rotating direction of a coin C, and it guides a coin C advancing to deviate from the coin passage 306 to the coin passage 306. In other words, the guide face 544 forms an acute angle to an extension line 546 of the guide face 354. A side portion of the guide face 544 nearest the coin passage 306 has a clearance slightly larger than the thickness of a coin C to the extension line 546 of the guide face 354. The guide face 544 is for guiding the coin C rolling in the coin passage 306 to the coin detecting passage 314 smoothly. A portion of the guide face 544 corresponding to the upper cancel piece 502A and the lower cancel piece 502B is formed in an inclined face 548 such that a distance between the portion and the upper cancel piece 502A and the lower cancel piece 502U increases downwardly. The portion of the guide face 544 is for facilitating dropping of a coin C to be cancelled by the upper cancel piece 502A and the lower cancel piece 502B. A downstream edge 550 of the coin passage 306 of the moving direction changing portion guide body 522 is formed in an inclined manner such that a distance between the upper cancel piece 502A and the lower cancel piece 502B gradually increases in order to facilitate rolling of a coin C to the cancel passage 456 and dropping of the coin C. In other words, a distance between the upper guide edge 508A and the lower guide edge 508U, and the downstream edge 550 is defined such that an upper end side of a coin C pushed by the upper cancel piece 502A and the lower cancel piece 502B is rotated about a lower end of the coin C contacting with the guiding body 386 serving as a fulcrum and the coin C can be reversed upside down to drop in the cancel passage 456. It is preferable that the guide face 544 of a coin C gradually becomes large. In order to satisfy both the requirements, the moving direction changing portion guide body 522 is formed in a downward tapered knife shape in the fourth embodiment.

Figure 23:
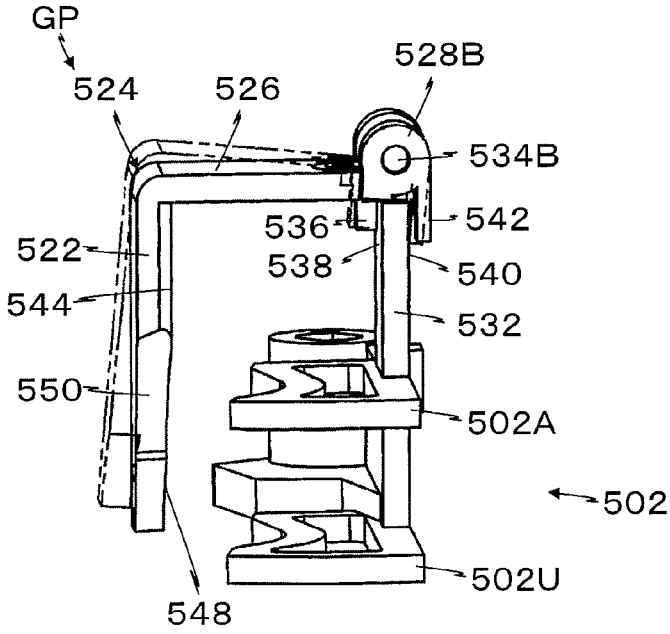
FIG. 23 is an explanatory view for explaining an operation of the cancel body and the moving direction changing portion guide body of the coin selector according to the fourth embodiment of the present invention.

Since the inverted L-shaped body 524 generates self-moment in a counterclockwise direction about the shafts 534A and 534B in FIG. 23, the moving direction changing portion guide body 522 is held by a predetermined biasing force at the guide position GP where the guide position engaging piece 536 is stopped by the stopper face 538. On the other hand, when a plurality of coins C are jammed between the upper cancel piece 502A and the lower cancel piece 502U, and the moving direction changing portion guide body 522, since the moving direction changing portion guide body 522 can rotate until the rotation restricting piece 542 is engaged with the stopper face 540, pressure-contacting forces among the plurality of coins C can be kept in a predetermined pressure or less. In other words, frictional forces among the coins C can be kept in values which allow sliding of coins due to their own weights so that coins C can drop freely.

Figure 24:
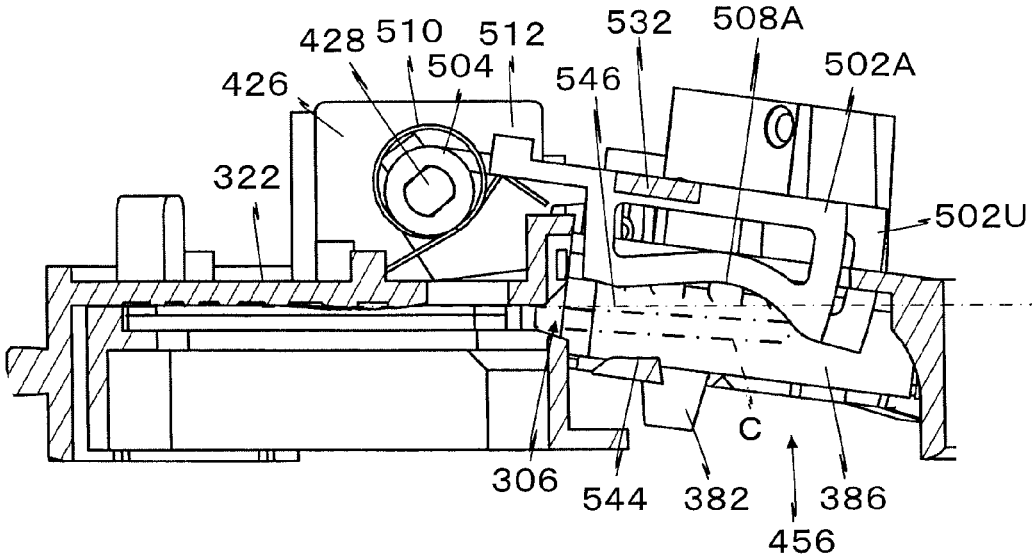
FIG. 24 is another explanatory view for explaining an operation of the cancel body and the moving direction changing portion guide body of the coin selector according to the fourth embodiment of the present invention.
Figure 25:
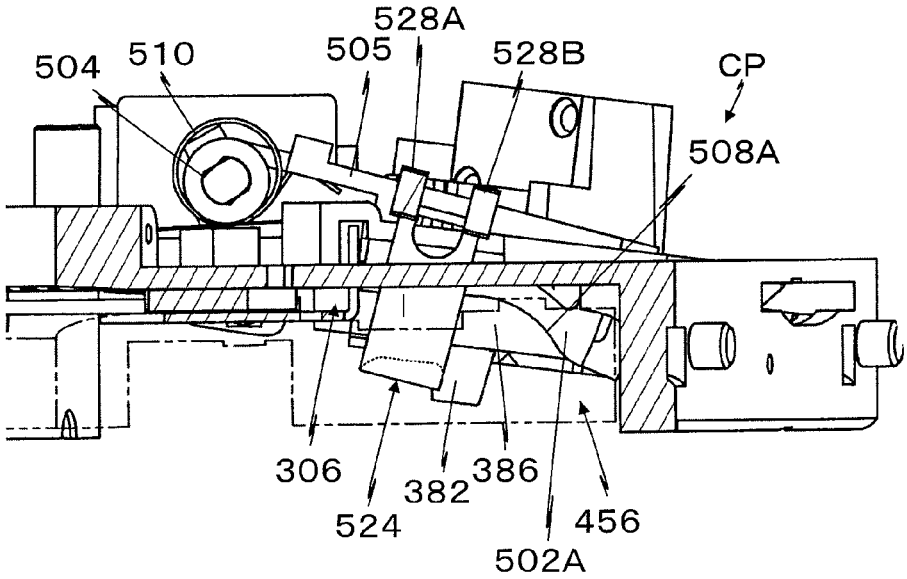
FIG. 25 is another explanatory view for explaining an operation of the cancel body and the moving direction changing portion guide body of the coin selector according to the fourth embodiment of the present invention.

Next, the operation of the fourth embodiment will be explained with reference to FIG. 24 and FIG. 25. First, a case that a real coin C is received will be explained.

When the coin selector 300 is put in a state that it can receive a coin C, since the rotary solenoid 426 is excited, the cancel body 502 is rotated in a counterclockwise direction, as shown in FIG. 22, and the upper cancel piece 502A and the lower cancel piece 502U are positioned outside the coin passage 306. The coin C that has passed through the real/fake discriminating portion 310 reaches the guiding body 386. At this time, since the coin C on the side face of the cancel passage 456 can be guided by the guide face 544, even if a rolling position of the coin C is deviated, the coin C is guided on the guiding body 386. Thereafter, the coin C is guided to the coin detecting passage 314 in the same manner as the explanation regarding the third embodiment.

Next, a case that a real coin C is cancelled will be explained. When a real coin C is cancelled, since the rotary solenoid 426 is demagnetized, the engaging portion 507 is rotated at a high speed by an attracting force of the magnet incorporated in the cancel body 502 and a spring force of the spring 510 until advance of the engaging portion 507 is blocked by a back face of the guide wall 322, and it is held at the cancel position CP shown in FIG. 25. In this case, since the coin C that has passed through the real/fake discriminating portion 310 is guided by the upper guide edge 508A and the lower guide edge 508U just before it rides on the guiding body 386, the coin C is deflected to the side of the supporting shaft 392 of the guiding body 386 to be caused to drop in the cancel body 456.

Next, in the case that a real coin C is cancelled, a case that the coin C has reached the guiding body 386 in the course of movement of the upper cancel piece 502A and the lower cancel piece 502U to the cancel position CP will be explained. The movement of the coin C to the coin detecting passage 314 is blocked by the upper cancel piece 502A and the lower cancel piece 502U in the course of movement to the cancel position CP just after the guiding body 386 slightly rotates due to a weight of the coin C and the coin C starts to drop to the side of the coin detecting passage 314 in a sliding manner, so that the coin C is pushed to the side of the cancel passage 456. Thereby, since an upper end portion of the coin C is pushed laterally about a lower end of the coin C placed on the guiding body 386 serving as a fulcrum, the coin C falls down to the cancel passage 456 from its upper end side, and the coin C is caused to roll laterally such that its upper end is inverted to a lower end thereof so that the coin C is cancelled.

Next, a case that three coins C have reached the guiding body 386 in a state that they are strung together like beads in the course of movement of the upper cancel piece 502A and the lower cancel piece 502U to the cancel position CP will be explained. In this case, before the first coin C rolls to the cancel passage 456, the next coin C reaches the cancel passage 456, so that a plurality of coins C, for example, three coins are jammed between the upper cancel piece 502A and the lower cancel piece 502U, and the moving direction changing portion guide body 522. In this case, the moving direction changing portion guide body 522 is rotated in a clockwise direction in FIG. 23 about the shaft 534A and 534B serving as a fulcrum until the rotation restricting piece 542 is engaged with the back face of the stay 534 (see a chain line). Since pressure-contacting forces among the plurality of coins C are reduced by the rotation, frictional forces among the coins C does not increase to a predetermined value or more. Thereby, when the upper cancel piece 502A and the lower cancel piece 502U are moved to the cancel position CP, the coin C is deflected from the guiding body 386. Therefore, the coin C which is not supported by the guiding body 386 can drop freely so that it is cancelled to the cancel passage 456. In other words, since the coin C can be cancelled even in the course of movement of the cancel body 502 to the cancel position CP, such a merit can be obtained that a so-called "swallowing" phenomenon where, even if a real coin C is inserted, the inserted coin is not counted does not occur.

While specific embodiments of the invention have been shown and described in detail to illustrate the application of the principles of the invention, it will be understood that the invention may be embodied otherwise without departing from such principles.

APPENDIX

Selected Reference Numerals/Letters

C: coin
108, 308: real/fake discriminating unit
106, 306: coin passage
112, 312: moving direction changing unit
114, 314: coin detecting passage
116, 316: coin sensor
134: first plane
136: second plane
144, 344: displacement guiding unit
146: inclined guide face
162: 318: coin cancel unit
386: guiding body
422, 502: cancel body
458, 522: moving direction changing portion guiding body
320: shutter unit
524: inverted L-shaped body
536: horizontal portion
532: stay

What is claimed is:

1. A coin selector comprising:

a coin passage which is approximately vertical, said coin passage including a guide rail, said coin passage includes a first plane and a second plane, said first plane being defined by the guide rail, said second plane being located side by side and downstream to said first plane, said second plane including a detecting passage;

a diameter sorting unit formed along said first plane of said coin passage through which a coin passes;

a moving direction changing unit provided in said first plane of said coin passage and positioned downstream from said diameter sorting unit, said moving direction changing unit being provided on an extending space of said guide rail, said moving direction changing unit including a guiding body pivotal about a supporting shaft between a standby position being an extension of said guide rail and a guiding position inclined downwardly toward said second plane by a weight of a coin, said supporting shaft being arranged at an obtuse angle to said first plane of said coin passage, said guiding body including a distal edge spaced from said supporting and shaft, said distal edge being formed in a saw tooth shape;

a coin sensor detecting passage of a coin and issuing a signal, said coin sensor being located in said detecting passage.

2. A coin selector according to claim 1, further comprising a coin cancel unit disposed on the moving direction changing unit.

3. A coin selector according to claim 1, wherein said coin sensor is disposed in the coin detecting passage positioned downstream of the moving direction changing unit.

4. A coin selector according to claim 1, wherein the first plane and the second plane are inclined relative to a horizontal line.

5. A coin selector according to claim 1, further comprising:

a timing sensor disposed between said diameter sorting unit and the moving direction changing unit.

6. A coin selector according to claim 1, wherein a coin passage in the moving direction changing unit and the coin detecting passage are connected to each other through a displacement guiding unit.

7. A coin selector according to claim 6, wherein the displacement guiding unit includes an inclined guiding face inclined to the first plane.

8. The coin selector according to claim 1, further comprising:

a cancel body that advances to and retracts from a coin passage positioned above guiding body and has an inclined guiding edge inclined from a side of the coin detecting passage above said guiding body to the side of a pivoting shaft, and a moving direction changing portion guiding body positioned upstream of the cancel body and defining a side face of the coin passage on an opposite side of the cancel body, wherein:

the guiding body can pivotally move about a pivoting shaft at an opposite side of said diameter sorting unit.

9. A coin selector according to claim 1, wherein:

the coin sensor comprises a plurality of detectors, each of said plurality of detectors comprises a detector of a different detecting system or type.

10. A coin selector according to claim 1, further comprising:

a shutter unit for closing the coin detecting passage except for a time for passage of a coin, said shutter unit being disposed downstream of the coin sensor.

11. A coin selector according to claim 10, wherein the shutter unit is held at a closing position of the coin passage due to the moment of the shutter unit.

12. A coin selector according to claim 8, wherein the moving direction changing portion guiding body moves integrally with the cancel body, can move in a direction of separating from the cancel body, and is biased toward the side of the cancel body by a predetermined moment.

13. A coin selector according to claim 12, wherein the moving direction changing portion guiding body is formed in an inverted L-shaped body, a distal end portion of a horizontal portion being rotatably attached at an upper end of a stay extending from the cancel body upwardly, and the moving direction changing portion guiding body is rotatable in a direction in which a lower end thereof separates from the cancel body and is biased to the side of the cancel body by its own weight.

14. A coin selector comprising:

a coin passage having a first part in a first plane, and a second part in a second plane, said first plane and said second plane being spaced from each other, said first part having a coin entrance, said second part having a coin exit, said coin passage being arranged to move coins from said coin entrance to said first part, then to said second part, and then out of said coin exit;

a diameter sorting unit arranged along said first part of said coin passage;

a moving direction changing unit arranged at a downstream end of said first part of said coin passage, said moving direction changing unit including a guiding body supporting a coin in said moving direction changing unit, said guiding body being pivotal between a standby position and a guiding position about a pivot axis, said standby position of said guiding body blocking movement of a coin from said first part of said coin passage to said second part of said coin passage, said guiding body moving from said standby position to said guiding position by a weight of a coin in said moving direction changing unit, said guiding position of said guiding body guiding a coin from said first part of said coin passage to said second part of said coin passage, said pivot axis being arranged at an obtuse angle to said first part of said coin passage;

a coin sensor arranged in said second part of said coin passage, said coin sensor detecting a passage of a coin and generating a signal based on the passage of a coin.

15. A coin selector according to claim 14, further comprising:

a coin cancel unit arranged in said moving direction changing unit.

16. A coin selector according to claim 14, further comprising:

a timing sensor disposed between said diameter sorting unit and said moving direction changing unit.

17. A coin selector according to claim 14, wherein:

said guiding body includes a distal edge spaced from said pivot axis, said distal edge being arranged at an obtuse angle to said first part of said coin passage.

18. A coin selector according to claim 17, wherein:

said pivot axis and said distal edge being arranged to spin an upstream end of a coin as the coin moves past said guiding body.

19. A coin selector according to claim 14, wherein:

said guiding body includes a distal edge spaced from said pivot axis, said distal edge being formed in a saw tooth shape.

20. A coin selector according to claim 14, wherein:

said guiding body includes a distal edge spaced from said pivot axis, said distal edge of said guiding body projects partially into said second part of said coin passage to block a coin in said second part of said coin passage from being pulled back into said first part of said coin passage.

21. A coin selector comprising:

a coin passage having a first part in a first plane, and a second part in a second plane, said first plane and said second plane being spaced from each other, said first part having a coin entrance, said second part having a coin exit, said coin passage being arranged to move coins from said coin entrance to said first part, then to said second part, and then out of said coin exit;

a diameter sorting unit arranged along said first part of said coin passage;

a moving direction changing unit arranged at a downstream end of said first part of said coin passage, said moving direction changing unit including a guiding body supporting a coin in said moving direction changing unit, said guiding body being movable between a standby position and a guiding position, said standby position of said guiding body blocking movement of a coin from said first part of said coin passage to said second part of said coin passage, said guiding body moving from said standby position to said guiding position by a weight of a coin in said moving direction changing unit, said guiding position of said guiding body guiding a coin from said first part of said coin passage to said second part of said coin passage, said guiding body including a distal edge arranged to strike against the coin at an obtuse angle;

a coin sensor arranged in said second part of said coin passage, said coin sensor detecting a passage of a coin and generating a signal based on the passage of a coin.

22. A coin selector according to claim 21, wherein:

said distal edge of said guiding body is formed in a saw tooth shape and projects partially into said second part of said coin passage to block a coin in said second part of said coin passage from being pulled back into said first part of said coin passage.

23. A coin selector according to claim 21, wherein:

said guiding body is pivotal between said standby position and said guiding position about a pivot axis, with said pivot axis being arranged at an obtuse angle to said first part of said coin passage.

24. A coin selector according to claim 21, wherein:

said distal edge is arranged at an obtuse angle to said first part of said coin passage.

25. A coin selector according to claim 21, wherein:

said guiding body is pivotal between said standby position and said guiding position about a pivot axis, said pivot axis and said distal edge being arranged to spin an upstream end of a coin as the coin moves past said guiding body.

* * * * *